US012214989B2

(12) United States Patent
Veis et al.

(10) Patent No.: US 12,214,989 B2
(45) Date of Patent: Feb. 4, 2025

(54) MEDIA SHEET CONVEYANCE WITH TRANSPORT ASSEMBLIES

(71) Applicant: HP SCITEX LTD., Netanya (IL)

(72) Inventors: Alex Veis, Netanya (IL); Semion Birger, Netanya (IL)

(73) Assignee: HP SCITEX LTD., Netanya (IL)

( * ) Notice: Subject to any disclaimer, the term of this patent is extended or adjusted under 35 U.S.C. 154(b) by 107 days.

(21) Appl. No.: 17/747,753

(22) Filed: May 18, 2022

(65) Prior Publication Data

US 2022/0402715 A1 Dec. 22, 2022

(30) Foreign Application Priority Data

Jun. 17, 2021 (EP) ..... 21180021

(51) Int. Cl.

| | |
|---|---|
| ***B65H 5/22*** | (2006.01) |
| ***B41J 11/08*** | (2006.01) |
| ***B65H 7/20*** | (2006.01) |
| ***B65H 29/24*** | (2006.01) |

(52) U.S. Cl.

CPC ..... *B65H 5/224* (2013.01); *B65H 7/20* (2013.01); *B65H 2406/32* (2013.01); *B65H 2801/03* (2013.01)

(58) Field of Classification Search

CPC .. B65H 5/224; B65H 29/242; B65H 2406/32; B65H 2406/3223; B65H 2406/32231; B65H 2406/3124; B65H 2301/44735; B41J 11/085; B41J 11/007; B41J 15/048

See application file for complete search history.

(56) References Cited

U.S. PATENT DOCUMENTS

| | | | |
|---|---|---|---|
| 3,889,801 | A | 6/1975 | Boyer |
| 4,753,119 | A | 6/1988 | Kuspert |
| 5,507,481 | A | 4/1996 | Meyer et al. |

(Continued)

FOREIGN PATENT DOCUMENTS

| | | | |
|---|---|---|---|
| DE | 102004045486 | A1 | 5/2005 |
| EP | 0193567 | B1 | 12/1987 |

(Continued)

OTHER PUBLICATIONS

Bell-Everman, "Linear Motion Engineering Guide", Oct. 2018 [Online] Available at: https://www.bell-everman.com/linear-motion-engineering-guide.

(Continued)

*Primary Examiner* — Luis A Gonzalez

(74) *Attorney, Agent, or Firm* — Jordan IP Law, LLC

(57) ABSTRACT

In an example, a media sheet conveyance system includes a first transport assembly, a plurality of subject transport assemblies, and a controller. The first transport assembly includes an endless first belt having a plurality of rows of holes, including a first and a second edge row separated by a distance "x". Each subject transport assembly includes an endless subject belt having a subject edge row of holes, with a distance to a nearest edge row of an adjacent transport assembly being less than or equal to the distance "x." The controller is to, in order to convey a media sheet, control a first drive roller to circulate the first belt over a first vacuum element set, and control a subject drive roller to circulate a subject belt over a subject vacuum element.

20 Claims, 17 Drawing Sheets

(56) References Cited

U.S. PATENT DOCUMENTS

| | | | | |
|---|---|---|---|---|
| 5,757,407 | A | 5/1998 | Rezanka | |
| 5,931,090 | A | 8/1999 | Ohkawa | |
| 5,940,105 | A | 8/1999 | Hayami | |
| 6,179,419 | B1 | 1/2001 | Rasmussen et al. | |
| 6,290,351 | B1 | 9/2001 | Merz | |
| 7,914,099 | B2 | 3/2011 | Loh et al. | |
| 8,839,941 | B2 | 9/2014 | Fehr et al. | |
| 2002/0018097 | A1 | 2/2002 | Kitahara et al. | |
| 2003/0038420 | A1 | 2/2003 | Cleary et al. | |
| 2005/0046667 | A1 | 3/2005 | Ando et al. | |
| 2006/0186593 | A1 | 8/2006 | Shibuya | |
| 2007/0045939 | A1 | 3/2007 | Toya et al. | |
| 2009/0301237 | A1 | 12/2009 | Everman | |
| 2010/0244364 | A1* | 9/2010 | Komiyama | B65H 29/242 271/99 |
| 2011/0128557 | A1 | 6/2011 | Kinoshita et al. | |
| 2011/0293346 | A1 | 12/2011 | Sato | |
| 2014/0178115 | A1* | 6/2014 | Fujisawa | B65H 5/224 271/264 |
| 2014/0240423 | A1 | 8/2014 | Cressman et al. | |
| 2017/0043598 | A1 | 2/2017 | Sanaei et al. | |
| 2018/0281472 | A1 | 10/2018 | Terradellas Callau et al. | |
| 2019/0291475 | A1 | 9/2019 | Ota | |
| 2020/0230981 | A1 | 7/2020 | Gunji | |
| 2020/0254789 | A1* | 8/2020 | Martin Orue | B41J 11/007 |
| 2022/0402282 | A1* | 12/2022 | Veis | B41J 11/007 |

FOREIGN PATENT DOCUMENTS

| | | | |
|---|---|---|---|
| EP | 1655141 | A2 | 5/2006 |
| EP | 3121021 | A2 | 1/2017 |
| EP | 3150391 | A2 | 4/2017 |
| EP | 3308969 | A1 | 4/2018 |
| EP | 3392048 | A1 | 10/2018 |
| EP | 3594005 | A1 | 1/2020 |
| JP | 57-156947 | A | 9/1982 |
| JP | 07-187441 | A | 7/1995 |
| JP | 07-281495 | A | 10/1995 |
| JP | 4057115 | B2 | 3/2008 |
| JP | 2019-001646 | A | 1/2019 |
| WO | 2021/142326 | A1 | 7/2021 |

OTHER PUBLICATIONS

Okawa, Elji, Printing Press, Mar. 2, 1999, Japan, 31 pages (Year: 1999).

* cited by examiner

MEDIA SHEET CONVEYANCE WITH TRANSPORT ASSEMBLIES

BACKGROUND

A printer may apply print agents to a paper or other media to produce an image upon the media. One example of printer is a corrugate sheet-fed printer that is to apply the print agents to a sheet of corrugate media fed through the printer via a series of rollers. In certain examples, print agent application elements at the printer may apply a print agent via inkjet (e.g., thermal inkjet or piezo inkjet), liquid toner, or dry toner printing technologies.

One of the most significant factors affecting print quality for large industrial printers is the accuracy of the media motion. Errant media handling at a printer can result in misregistration between colors, image grain, and ill-defined text and barcodes.

DRAWINGS

DETAILED DESCRIPTION

Figure 1:
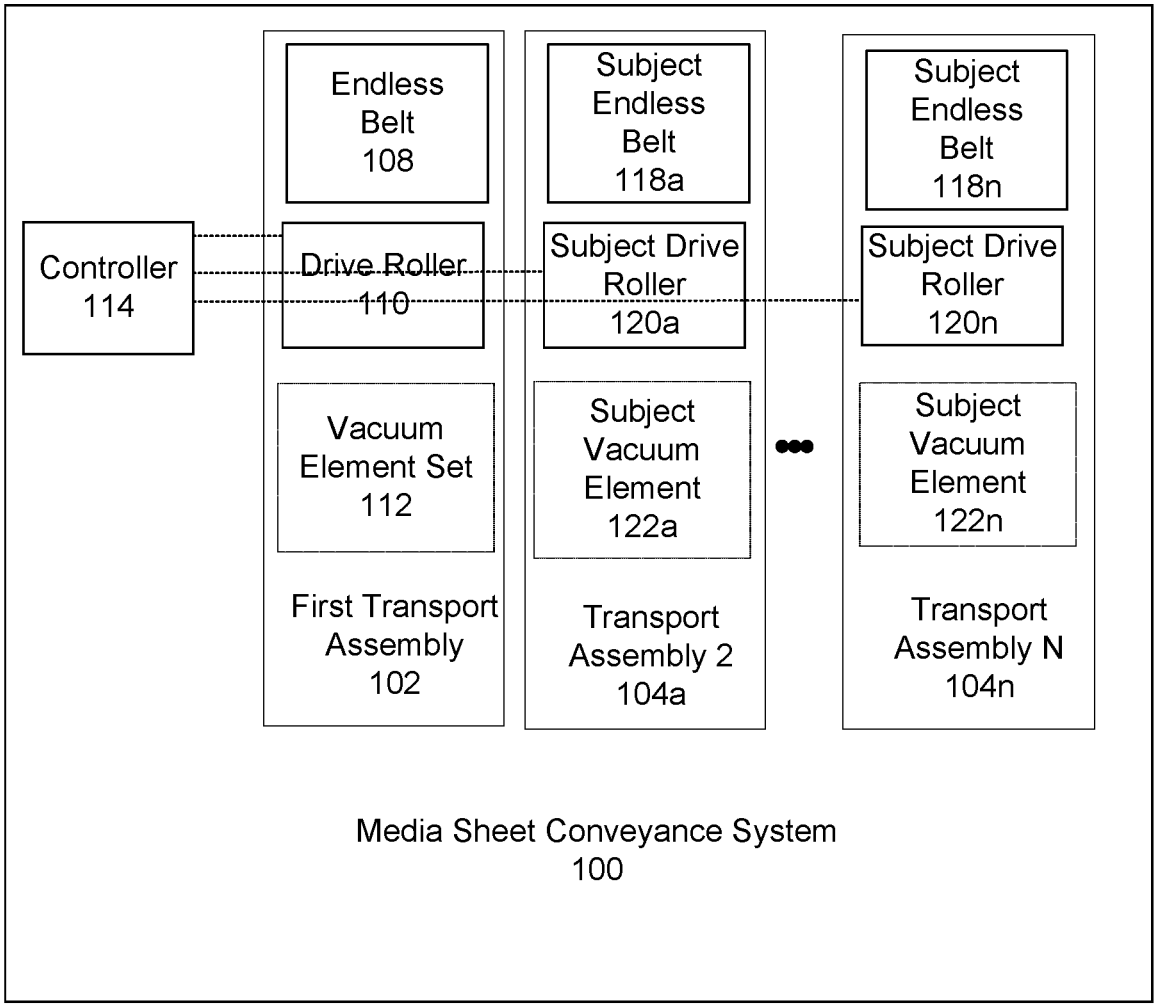
FIG. 1 is a block diagram depicting an example of a media sheet conveyance system.

Certain industrial printers utilize printheads mounted on printbars to deposit inks or other print agents upon a sheet of media. In examples the media sheets may range from 50 cm×50 cm to from 180 cm×250 cm, with the media weighing up to 10 kilograms. Some industrial printers have incorporated moving pallets, train and wagons on tracks, and/or vertical drops to transport such medias through a printer for printing with a high level of success. However, such systems can be challenging to scale for use with industrial printers that would print at higher speeds. Other industrial sheet-fed printers incorporate media transport systems that rely upon flexible belts for transporting the media. However, such systems have typically included a multitude of closely arranged belts to achieve media motion accuracy, with the result that such systems can be expensive and complex.

To address these issues, various examples described in more detail below provide a new system for media conveyance using transport assemblies that enable accurate media sheet transfer at a lower cost and complexity. In examples of the disclosure, a media sheet conveyance system includes a first transport assembly, a set of subject transport assemblies, and a controller. The first transport assembly includes an endless first belt having a multiple rows of holes. The multiple rows include a first and a second edge row separated by a distance "x."

The first transport assembly includes a first drive roller operatively connected to the first belt, and a first vacuum element set positioned adjacent and beneath a surface of the first belt. Each of the subject transport assemblies of the set of subject transport assemblies includes an endless subject belt having a subject edge row of holes, with a distance to a nearest edge row of an adjacent transport assembly being less than or equal to the distance "x." A subject drive roller is operatively connected to the subject belt, and a subject vacuum element is positioned adjacent and beneath a surface of the subject belt.

The controller is to control the first drive roller and the subject drive rollers to move a media sheet, including controlling the first drive roller to circulate the first belt over the first vacuum element set and controlling a subject drive roller to circulate a subject belt over the subject vacuum element. The suctions created by the vacuum elements, applied through the holes of the first belt and the subject belts, are to cause the media sheet to be held tightly to the first belt and the subject belts.

In certain examples, the first transport assembly includes a first encoder unit to measure movement of the first belt, and each of the plurality of subject transport assemblies includes a subject encoder unit to measure movement of the subject belt. In such instances, the controller is operatively connected to the first encoder unit and to each of the subject encoder units, and is to control the first drive roller and the subject drive rollers based upon belt movements measured by the first encoder unit and the subject encoder units.

In particular examples, the system for media conveyance is included within a printer that is to apply a print agent to a media sheet in a print zone of the printer. In examples, the controller is to control the first drive roller and the subject drive rollers to making skew correction adjustments in the speed of a belt as the media sheet is conveyed by the first and subject belts through the print zone based upon belt movements measured by the first and subject encoder units. In certain examples, the controller is to control the first drive roller and the subject drive rollers to accurately correct for any unwanted variations in belt speeds as the media sheet is conveyed through the print zone. In particular examples the first and subject encoder units are positioned within the print zone to increase accuracy of the measurements of belt movements within the print zone.

Users and providers of printers and other devices will appreciate that the disclosed system enables precise movement of media sheets through a printers' print zone utilizing significantly less media conveyance hardware and reduced control complexity as compared to current systems. Media sheets of varying widths may be accurately transported through a printer's print zone with greater precision, while utilizing significantly less belts and belt surfaces, than with existing belt conveyor systems. Installations and utilization of printers that include the disclosed system should thereby be enhanced.

FIGS. 1-15D depict examples of physical and logical components for implementing various examples. In FIGS. 1-13D, and 15A-15D a component is described as a controller 114. In describing controller 114 focus is on the controller's designated function. However, the term controller, as used herein, refers generally to hardware and/or programming to perform a designated function. As is illustrated later with respect to FIG. 14, the hardware of the controller, for example, may include one or both of a processor and a memory, while the programming may be code stored on that memory and executable by the processor to perform the designated function.

FIG. 1 is a block diagram depicting an example of a system 100 for media conveyance with multiple transport assemblies. In this example, the media conveyance system 100 includes a first transport assembly 102, and a set of subject transport assemblies 2 (104*a*)-N (104*n*). The first transport assembly 102 has an endless first belt 108 having a plurality of rows of holes, the plurality including a first and a second edge row separated by a distance "x", a first drive roller 110 operatively connected to a drive surface (see e.g., 308, FIGS. 12A-12D) of the first belt, and a first vacuum element set 112 positioned adjacent and beneath the drive surface of the first belt 108 (see e.g., 308, FIGS. 3A and 3B). In examples the first vacuum element set 112 may include a plurality of individual vacuum elements each positioned adjacent and beneath one of the rows of the plurality of rows of holes of the first belt 108. In other examples the first vacuum element set 112 may include a single vacuum element that has a set of channels, with each channel positioned adjacent and beneath one of the rows of the plurality of rows of holes of the first belt 108.

As used herein a "belt" refers generally to a loop, e.g. a continuous loop, of material that is to link to rollers (such rollers are sometimes referred to as rotating shafts). In examples the belt may be made of, or include, natural rubber, vulcanized rubber, synthetic rubber, PVC or other materials. In examples the belt may be a belt of any of these materials, and also include metal reinforcing material. Such belts are sometimes referred to as timing belts.

As used herein a "drive surface" of a continuous belt is a side of the belt that is to engage a drive roller such that a drive roller can actuate the belt. As used herein a "drive roller" refers generally to a roller, pulley, or other substantially round element that is operatively connected to a driver surface of a continuous belt and operatively connected to a motor or other actuator, such that the drive roller is to rotate and thereby cause movement or circulation of the continuous belt. As used herein an "edge row" of holes of a belt refers generally to a row of holes that is extended along an edge of the continuous belt. As used herein an "edge" of a continuous belt is an imaginary line where a flat surface of a belt (e.g. a flat surface that is to support a media sheet) ends. As used herein a "vacuum element" refers generally to an apparatus or system that is to causes application of a suction or a negative pressure.

Each subject transport assembly 2-N of the set of subject transport assemblies includes an endless subject belt (e.g., 118*a* and 118*n*) having a subject edge row of holes, with a distance to a nearest edge row of an adjacent transport assembly being less than or equal to the distance "x." Each subject transport assembly 2-N of the set of subject transport assemblies includes a subject drive roller (120*a*-120*n*) operatively connected to a drive surface (see e.g. 408 FIGS. 13A-13D) of the subject belts 118*a*-118*n*, and a subject vacuum element 122*a*-122*n* positioned adjacent and beneath a drive surface of the subject belt. The media conveyance system 100 includes a controller 114 to control the first drive roller 110 and the subject drive rollers 120*a*-120*n* to move a media sheet. The controlling includes controlling the first drive roller 110 to circulate the first belt 108 over or above the first vacuum element set 112, and controlling a subject drive roller 120*a* to circulate a subject belt 118*a* over the subject vacuum element 122*a*, and controlling the subject drive roller 120*n* to circulate a subject belt 118*n* over the subject vacuum element 122*n*.

Figure 2A:
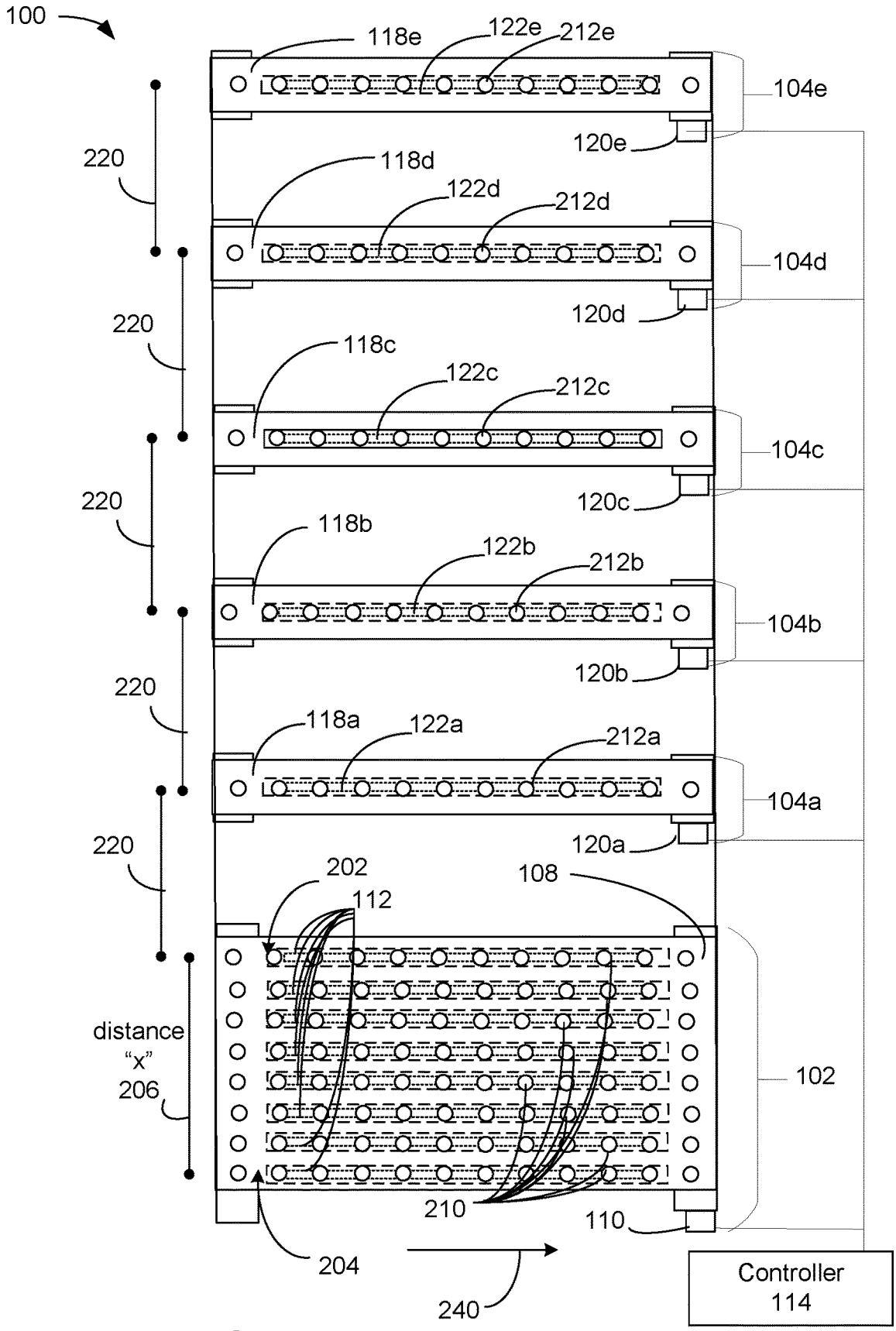
FIGS. 2A and 2B are simple schematic diagrams that illustrate in plan view an example of a media sheet conveyance system.

FIG. 2A is a simple schematic diagram that illustrates an example of a media sheet conveyance system. In this example, the media conveyance system 100 includes a first transport assembly 102, and a set of subject transport assemblies 2 (FIG. 2 104*a*)-5 (FIG. 2 104*e*).

The first transport assembly 102 has a first drive roller 110 operatively connected to a drive surface (see e.g., 308 FIGS. 12A-12D) of the first belt 108, and has a first vacuum element set 112 positioned adjacent and beneath the drive surface of the first belt 108. In this example, the plurality of rows of holes of the first belt 108 extend along length of the endless first belt 108, and the first edge row 202 of holes and the second edge row 204 of holes of the first belt 108 are separated, in a direction orthogonal to the length of the belt, by the distance "x" 206.

Figure 2B:
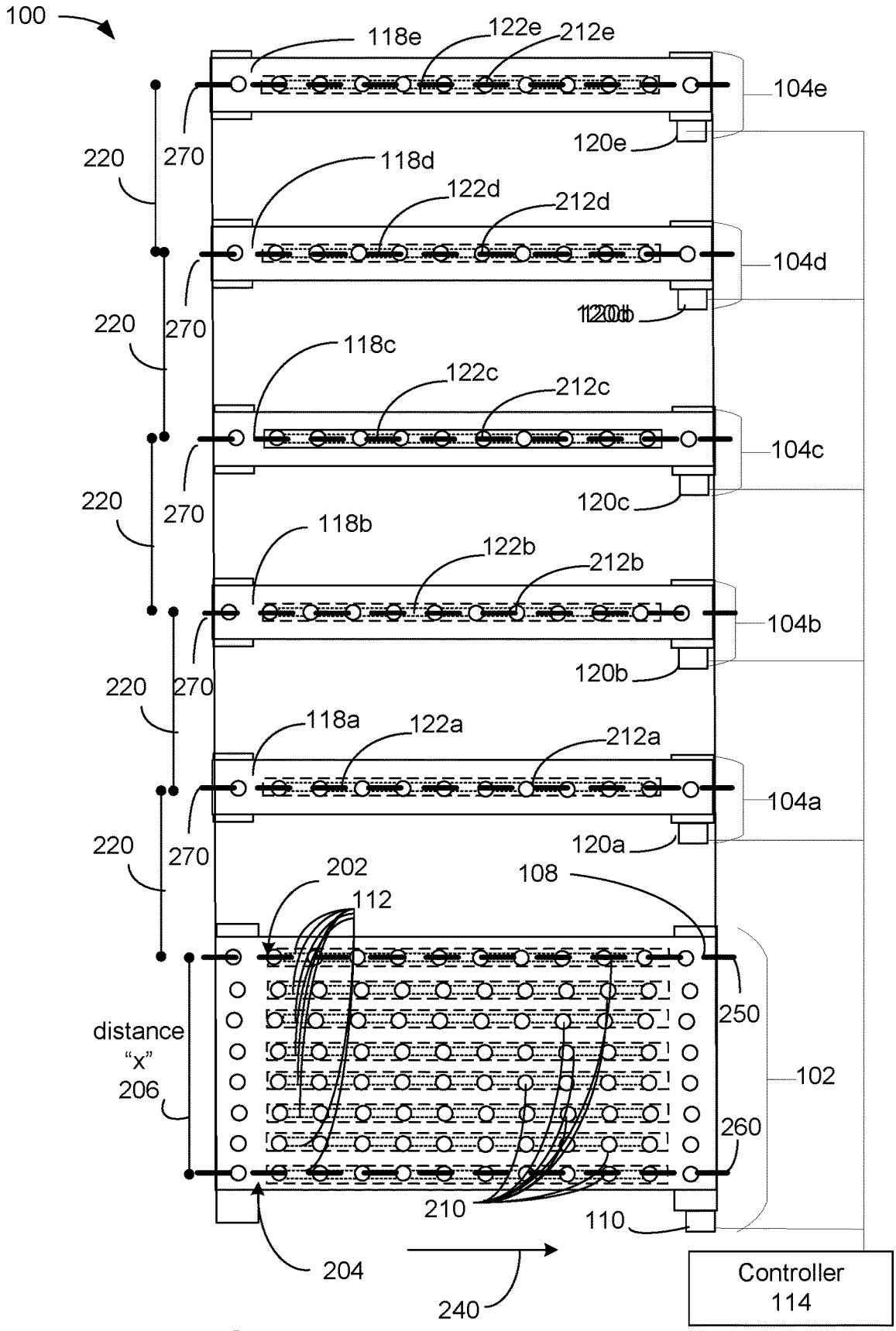

Moving to FIG. 2B, in examples the distance "x" measured between the first edge row 202 and the second edge row 204 of the first belt 108 may be a distance measured from an imaginary centerline 250 that connects the centers of the holes of the first edge row 202 and an imaginary centerline 260 that connects the centers of the holes the second edge row 204.

Returning to FIG. 2A, each of the subject transport assemblies 1-5 of the set of subject transport assemblies 104*a*-104*e* includes an endless subject belt (118*a*, 118*b*, 118*c*, 118*d*, 118*e*) having a subject edge row of holes (212*a*, 212*b*, 212*c*, 212*d*, 212*e*), with a distance 220 to a nearest edge row of an adjacent transport assembly being less than or equal to the distance "x." Each of the subject transport assemblies 1-5 of the set of subject transport assemblies 104*a*-104*e* includes a subject drive roller (120*a*, 120*b*, 120*c*, 120*d*, 120*e*) operatively connected to a drive surface of the subject belt (118*a*, 118*b*, 118*c*, 118*d*, 118*e*), and a subject vacuum element (122*a*, 122*b*, 122*c*, 122*d*, 122*e*) positioned adjacent and beneath the drive surface of the subject belt. It should be noted that while FIG. 2A and other figures of this disclosure are described as having five subject transport assemblies 104*a*-104*e*, in other examples the media conveyance system 100 may include any plurality of subject transport assemblies.

Returning to FIG. 2B, in examples the distance 220 (that is less than the distance "x" 260) between the edge row 212*a* of the subject transport assembly 1 104*a* and the nearest edge row 202 of the first transport assembly 102 is a distance measured between an imaginary centerline 270 that connects the centers of the holes of the edge row 212*a* of the subject transport assembly 1 104*a* and an imaginary centerline 250 that connects the holes of the first edge row 202 of the first transport assembly 102. Similarly, the distances 220 (that are less than the distance "x" 260) between an edge row (e.g. any of subject edge rows 212*a*-212*e*) of a subject transport assembly (e.g. any of subject transport assemblies 104*a*-104*e*) and a subject edge row of an adjacent transport assembly of transport assemblies 104*a*-104*e* are distances measured between centerlines 270 of the subject edge rows. For instance the distance 220 (that is less than the distance "x" 260) between the subject edge row 212*a* of the subject transport assembly 1 104*a* and an subject edge row 212*b* of an adjacent transport assembly 2 104*b* is a distance measured between the centerline 270 of the subject edge row 212*a* of subject transport assembly 1 104*a* and the centerline 270 of the subject edge row 212*b* of the subject transport assembly 2 104*b*.

It should be noted that while the FIGS. 2A, 2B, 6-9, 11, and 15A-15D are drawn such that the distance 220 between edge rows of various transport assemblies might be interpreted as being a same distance, this is not a requirement. For instance, looking at FIGS. 2A and 2B, the distance 220 between the first edge row 202 of the first transport assembly 102 and the subject edge row 212*a* of the subject transport assembly 1 104*a* could be, but is not required to be, a same distance as indicated between the subject edge row 212*a* of the subject transport assembly 1 104*a* and the subject edge row 212*b* of the subject transport assembly 2 104*b* adjacent to subject transport assembly 1. In other words, each occurrence of "distance 220" or reference number 220 as used herein represents any distance that is less than or equal to "distance "x" 206, and should not be interpreted as necessarily a same distance.

Figure 3A:
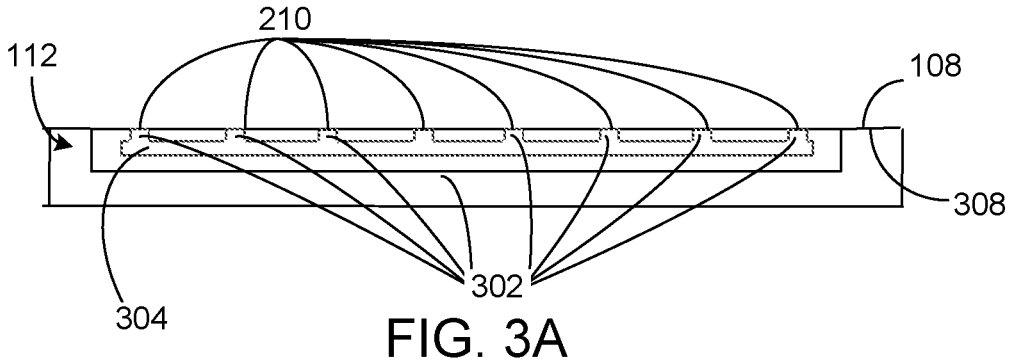
FIGS. 3A and 3B are simple schematic diagrams that illustrate in section views channel and vacuum source elements of example first transport assemblies.
Figure 3B:
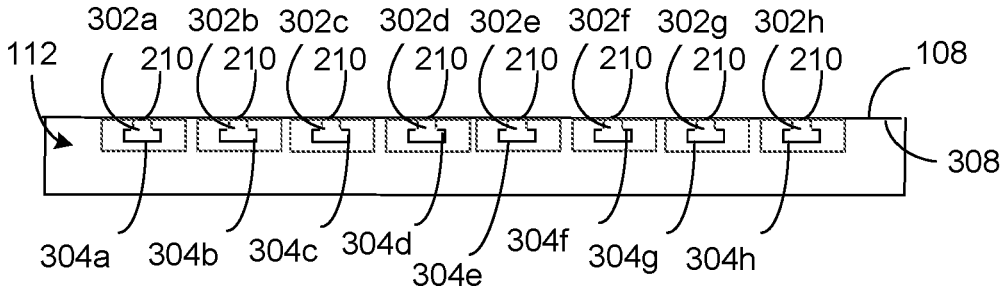

FIGS. 3A and 3B are simple schematic diagrams that illustrate in section views components of example first transport assemblies. FIG. 3A illustrates an example of a first vacuum element set 112 of a first transport assembly 102. The first vacuum element set is positioned adjacent and beneath a drive surface 308 of the first belt 108. In this example, the first vacuum element set 112 has a set of channels 302 connected to a same or common vacuum source 304. Each channel of the set of channels 302 is positioned adjacent to and beneath one of the rows of holes 210 (FIGS. 2A and 2B) of the first belt 108.

FIG. 3B illustrates another example of a first vacuum element set 112 of a first transport assembly 102. The first vacuum element set is positioned adjacent and beneath a drive surface 308 of the first belt 108. The first vacuum element set 112 has a set of a set of separate or distinct vacuum sources 304*a*-304*h*, with each of the separate or distinct vacuum sources 304*a*-304*h* connected to a dedicated channel of the channels 302*a*-302*h*. Each channel of the set of channels 302*a*-302*h* is positioned adjacent to and beneath one of the rows of holes 210 (FIGS. 2A and 2B) of the first belt 108.

Figure 3C:
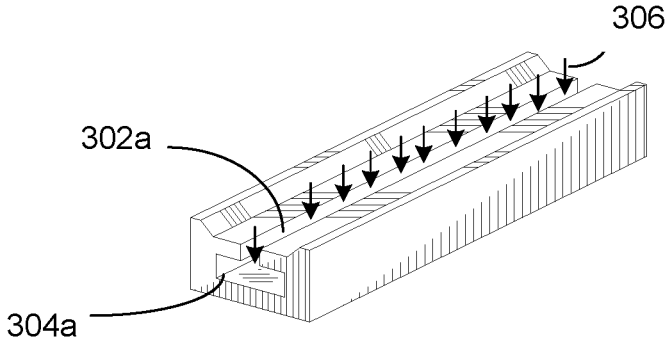
FIG. 3C is a simple schematic diagram that illustrates in perspective view channel and vacuum source elements of example first transport assemblies.

FIG. 3C is an illustration in perspective view of an example of a particular channel 302*a* and vacuum source 304*a* of the vacuum element set 112 of FIG. 3B.

In each of the examples of each of FIGS. 3A, 3B, and 3C, the channels (302, and 302*a*-302*g*) and the connected vacuum source(s) (304, 304*a*-304*g*) are for exposing a media sheet (see e.g., media sheet 1504 FIGS. 15A-15D) lying upon a surface of the first belt 108 (FIG. 2A), opposite the drive surface 308, to a negative pressure 306 FIG. 3C applied through the holes of the first belt 108 so as to cause the media sheet to be secured or held close to the first belt 108.

Figure 4A:
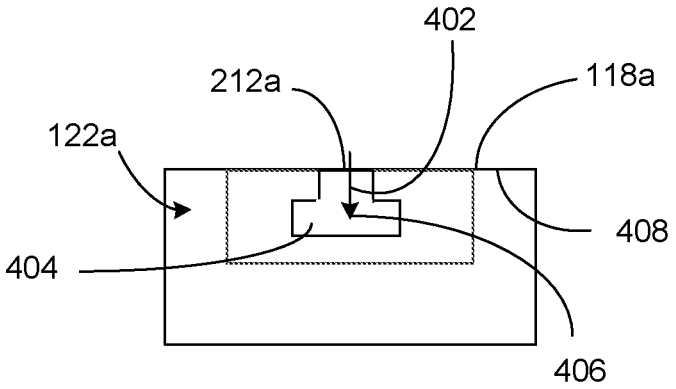
FIGS. 4A and 4B are simple schematic diagrams that illustrate in section and perspective views, respectively, elements of example subject transport assemblies
Figure 4B:
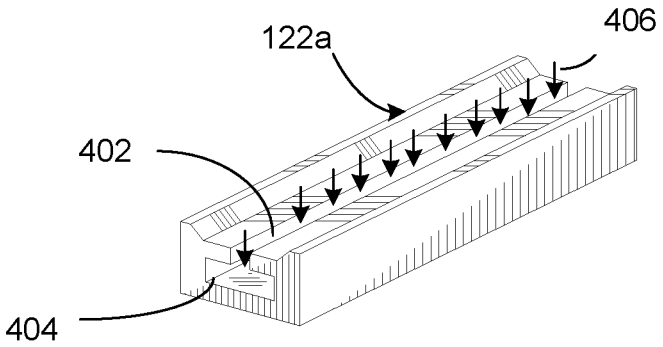

FIGS. 4A and 4B are simple schematic diagrams that illustrate in section and perspective views, respectively, example components of a subject transport assembly. In an example each subject transport assembly of subject transport assemblies 104*a*-104*e* (FIGS. 2A and 2B) has a subject vacuum element 122*a*-122*e* (FIGS. 2A and 2B) including a vacuum channel fluidly connected to a vacuum source.

Moving to FIG. 4A to look at the subject vacuum element 1 122*a* as an example, the subject vacuum element 1 122*a* is positioned adjacent and beneath a drive surface 408 of the subject belt 118*a*. The subject vacuum element 1 122*a* has a channel 402 connected to a vacuum source 404. The channel 402 and the vacuum source 404 are for applying a negative pressure 406 through a row of holes (212*a* FIG. 2A) of the subject belt 1 118*a* to cause a media sheet to be secured or held close to the subject belt 1 118*a*. In examples, the other subject vacuum elements 1-4 122*a*-122*e* have a same or similar architecture.

Returning to FIG. 2A, the media conveyance system 100 includes a controller 114 to control the first drive roller 110 and the subject drive rollers 120*a*-120*e* to move the first belt 108 and the subject belts 118*a*-118*e* in a media conveyance direction 240. The controlling includes controlling the first drive roller 110 to circulate the first belt 108 over the first vacuum element set 112, controlling the subject drive roller 1 120*a* to circulate the subject belt 1 118*a* over the vacuum element 1 122*a*, controlling the subject drive roller 2 120*b* to circulate the subject belt 2 118*b* over the vacuum element 2 122*b*, controlling the subject drive roller 3 120*c* to circulate the subject belt 3 118*c* over the vacuum element 3 122*c*, controlling the subject drive roller 4 120*d* to circulate the subject belt 4 118*d* over the vacuum element 4 122*d*, and controlling the subject drive roller 5 120*e* to circulate the subject belt 5 118*e* over the vacuum element 5 122*e*.

In examples, the controller 114 is to control the first vacuum element set 112 to apply a target negative pressure to the media sheet that lies upon the first belt through the holes in the first belt 108, and to control the subject vacuum elements 1-5 122*a*-122*e* to apply a target negative pressure to that media sheet through the holes in the subject belts 1-5 118*a*-118*e*. As used herein, a "target pressure" for a vacuum element refers generally to a predetermined pressure that the vacuum element is to create. In examples, the controller 114 may set a target pressure for a vacuum element, or a set of vacuum elements, according to received data indicative of a media attribute (e.g. thickness, weight, observed skew) or a printing attribute (e.g., a type of print job to be performed at a printer that incorporates the media conveyance system 100).

Figure 5:
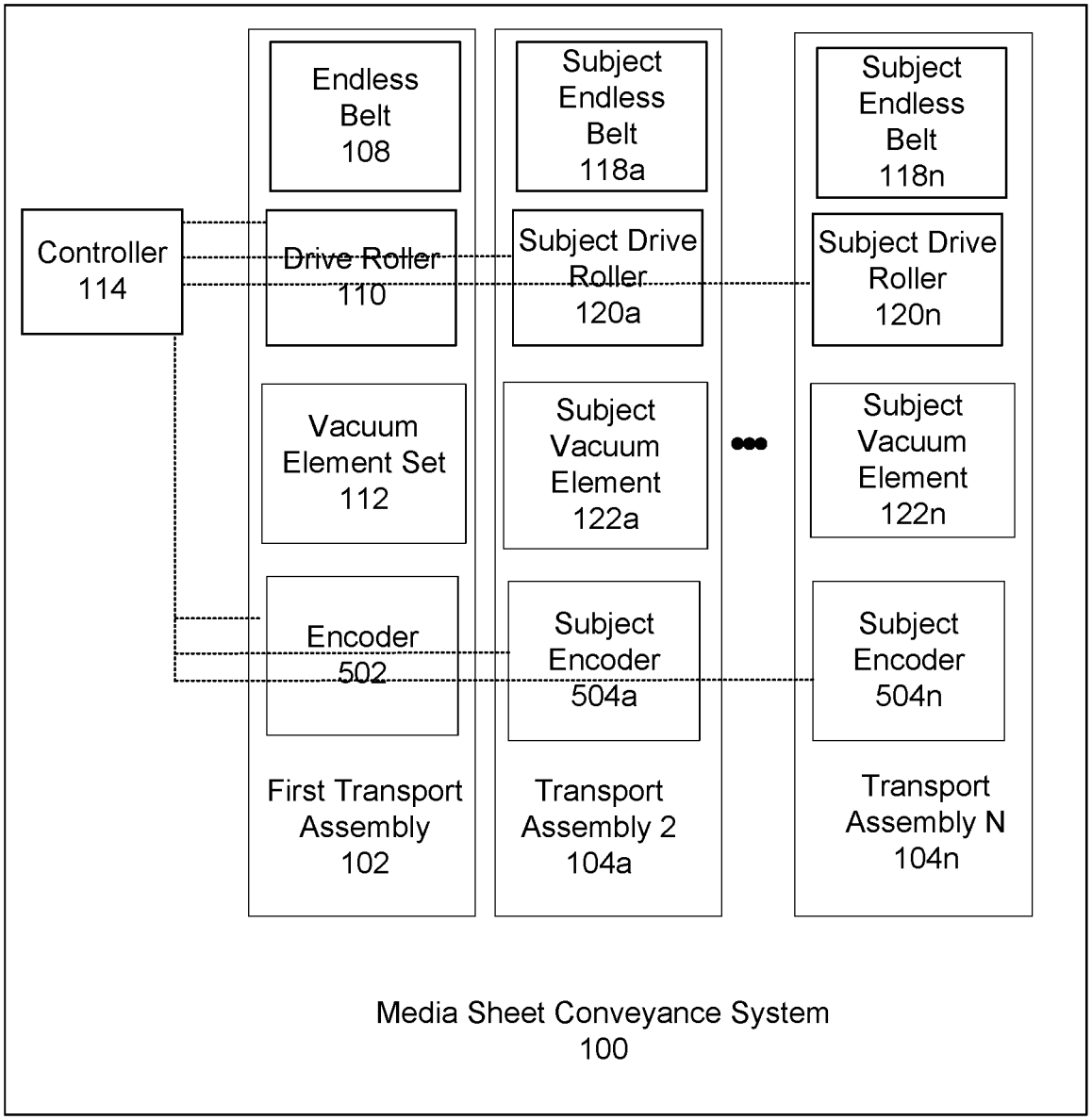
FIG. 5 is a block diagram depicting an example of a media sheet conveyance system wherein the first transport assembly and subject transport assemblies include encoder units.

FIG. 5 is a block diagram depicting an example of a media sheet conveyance system wherein the first transport assembly and subject transport assemblies include encoder units. In this example, the first transport assembly 102 includes a first encoder unit 502 to measure movement of an endless first belt 108, and each of a plurality of subject transport assemblies 104*a*-104*n* includes a subject encoder unit 504*a*-504*n* to measure movement of a subject belt 118*a*-118*n*. The controller 114 is operatively connected to the first encoder unit 502 and to each of the subject encoder units 504*a*-504*n*, and is to control the first drive roller 110 and the subject drive rollers 120*a*-120*n* to convey a media sheet based upon belt movement measurements made by the first encoder unit 502 and the subject encoder units 504*a*-504*n*.

Figure 6:
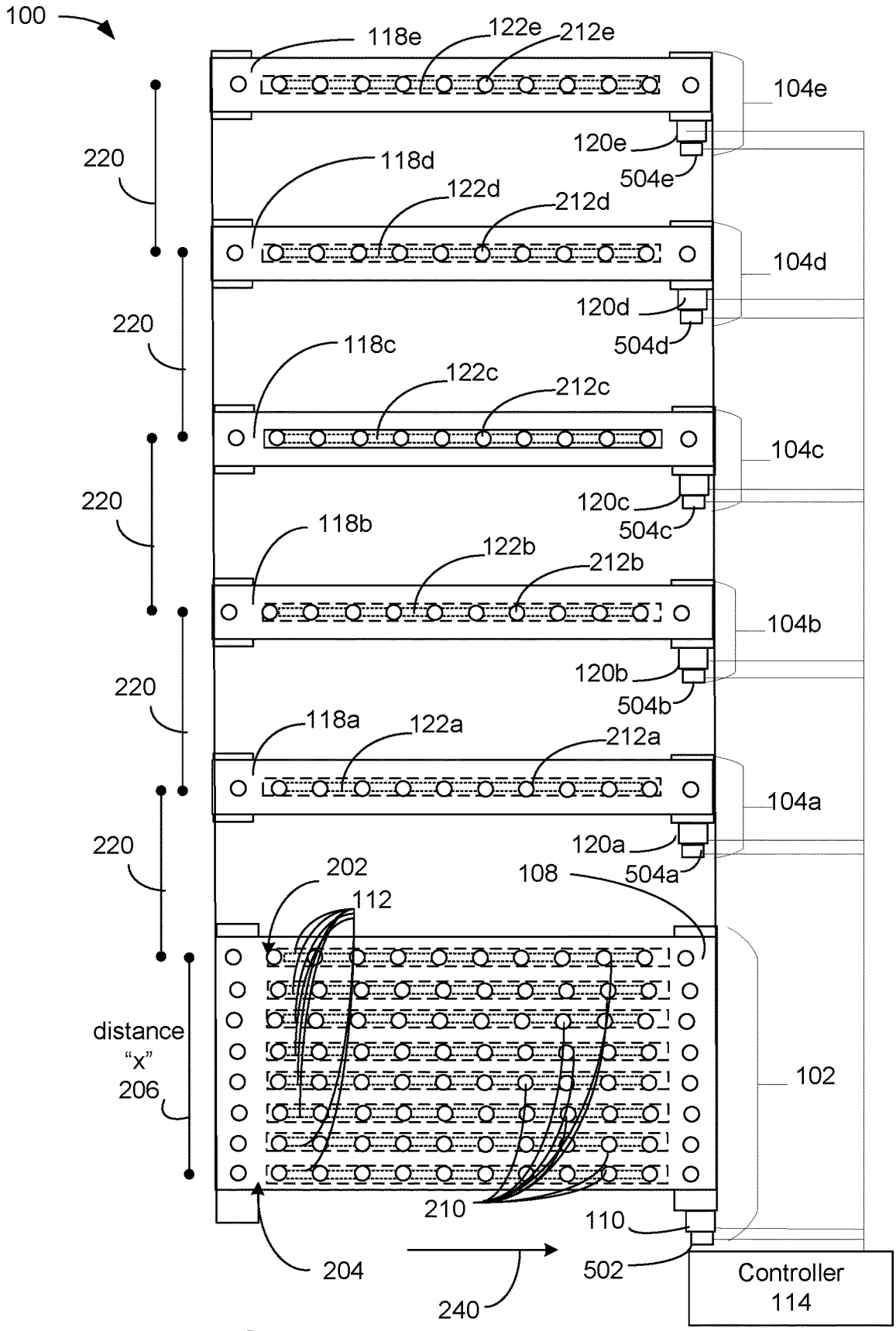
FIG. 6 is a simple schematic diagram that illustrates in plan view example components of a media sheet conveyance system wherein the first transport assembly and subject transport assemblies include encoder units.

FIG. 6 is a simple schematic diagram in plan view that illustrates example components of a media sheet conveyance system wherein the first transport assembly and the subject transport assemblies include encoder units. In this example, the first transport assembly 102 includes a first encoder unit 502 to measure movement of the first belt 108, and each of the plurality of subject transport assemblies 104*a*-104*e* includes a subject encoder unit 504*a*-504*e* to measure movement of a subject belt 118*a*-118*e*.

In the particular example of FIG. 5, the first encoder unit 502 is operatively connected to the drive roller 110 of the first transport assembly 102 to measure movement of the first belt 108. A subject encoder 504*a* is operatively connected to the drive roller 120*a* of the subject transport assembly 104*a* to measure movement of the subject belt 118*a*. A subject encoder 504*b* is operatively connected to the drive roller 120*b* of the subject transport assembly 104*b* to measure movement of the subject belt 118*b*. A subject encoder 504*c* is operatively connected to the drive roller 120*c* of the subject transport assembly 104*c* to measure movement of the subject belt 118*c*. A subject encoder 504*d* is operatively connected to the drive roller 120*d* of the subject transport assembly 104*d* to measure movement of the subject belt 118*d*. A subject encoder 504*e* is operatively connected to the drive roller 120*e* of the subject transport assembly 104*e* to measure movement of the subject belt 118*e*.

The controller 114 is operatively connected to the first encoder unit 502 and to each of the subject encoder units 504*a*-504*e*, and is, in order to convey a media sheet in a media conveyance direction 240, control the first drive roller 110 and the subject drive rollers 120*a*-120*e* based upon belt movement measurements made by the first encoder unit 502 and the subject encoder units 504*a*-504*e*.

In examples, the first encoder 502 and/or a subject encoder unit of subject encoder units 504*a*-504*e* may be operatively connected to a shaft of its respective drive roller 110 120*a*-120*e* to provide an indirect measurement of movement of the belt that is caused to be circulated by that drive roller. In other examples, the first encoder 502 and/or a subject encoder unit of subject encoder units 504*a*-504*e* may have a measuring wheel that is operatively connected to a surface of its respective drive roller to provide an indirect measurement of the belt that is caused to be circulated by that drive roller.

The controller 114 is operatively connected to the first encoder unit 502 and to each of the subject encoder units 504*a*-504*e*, and is to control the first drive roller 110 and the subject drive rollers 120*a*-120*e* based upon belt movement measurements made by the first encoder unit 502 and the subject encoder units 504*a*-504*e*. In examples controlling the first drive roller and/or the subject drive rollers includes varying speed of the first drive roller and/or the subject drive rollers based upon belt movements measured by the first encoder unit and the subject encoder unit.

Figure 7:
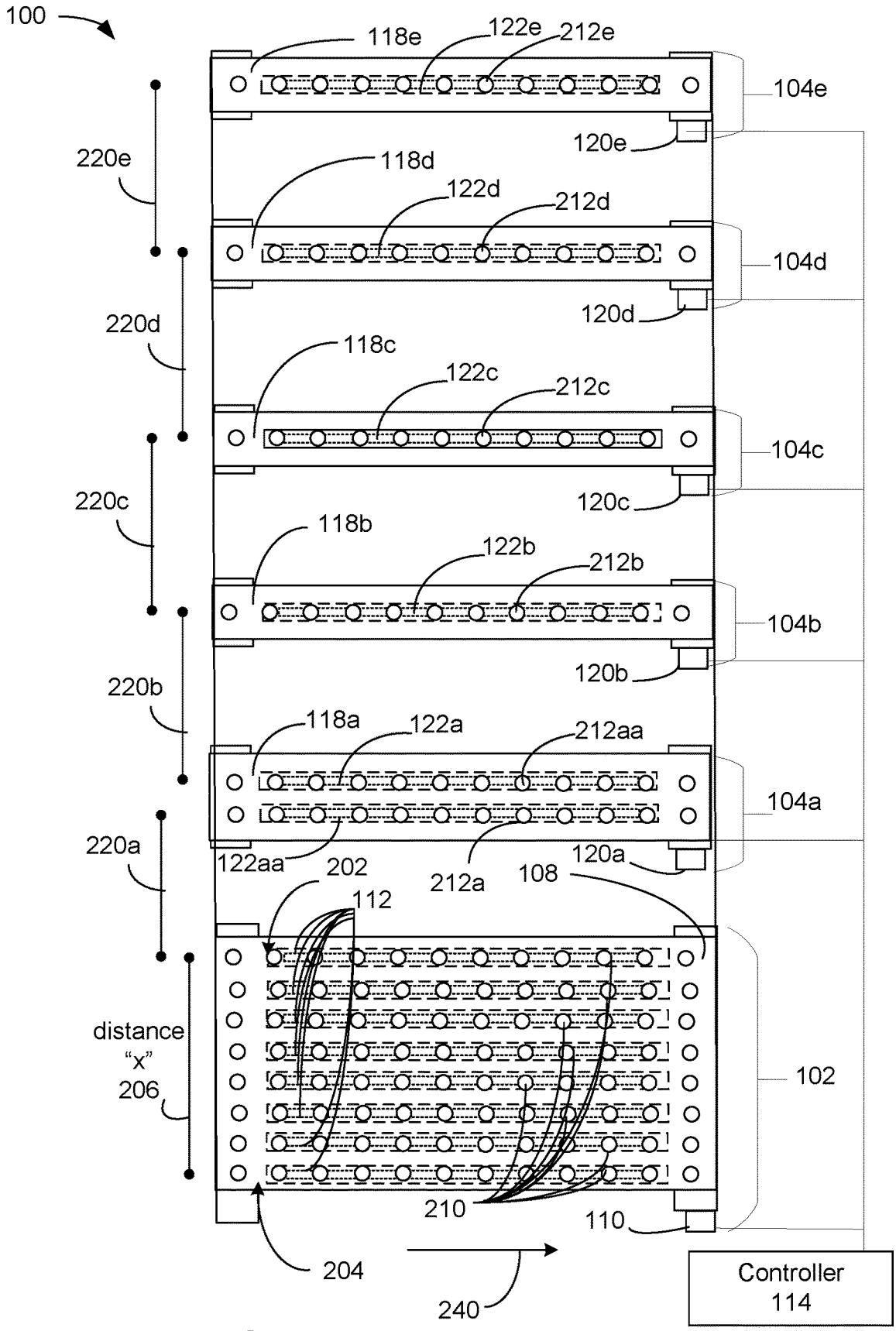
FIG. 7 is a simple schematic diagram that illustrates in plan view another example of a media sheet conveyance system.

FIG. 7 is a simple schematic diagram that illustrates in plan view another example of a media sheet conveyance system. The media conveyance system of FIG. 7 is substantially similar to the system as described with respect to FIG. 2A, except that in the example of FIG. 7 the particular subject transport assembly 1 104*a* of the plurality of subject transport assemblies includes two subject edge rows (a first subject edge row 212*a* and a second subject edge row 212*aa*), rather than a single subject edge row as disclosed with respect to FIG. 2A. In this example a subject edge row distance 220*a* between the first subject edge row 212*a* and a nearest edge row of holes 202 of a first adjacent transport assembly (here the first transport assembly 102) is less than or equal to the distance "x" 206. In this example a subject edge row distance 220*b* between the second subject edge row 212*aa* of the particular subject transport assembly 1 104*a* and a nearest edge row of holes 212*b* of an adjacent transport assembly (here the subject transport assembly 2 104*b*) is less than or equal to the distance "x" 206.

It should be noted that the distances 220*a* and 220*b*, and the other illustrated distances 220*c* 220*d* and 220*e* between subject transport assembly edge rows 212*b* and 212*c*, 212*c* and 212*d*, and 212*d* and 212*e*, respectively, need not be a consistent or same distance. Each of the distances 220*a* 220*b* 220*c* 220*d* and 220*e* represents a distance that is less than or equal to the distance "x" 206.

The subject transport assembly 1 of FIG. 7 has two rows of holes that are both subject edge rows 212*a* 212*aa*. In examples, a subject transport assembly may have more than two rows of holes in total, including two subject edge rows. In examples, any one, or more than one, of the subject transport assemblies 104*a*-104*e* of the media conveyance system 100 may have multiple rows of holes that include two subject edge rows.

Figure 8:
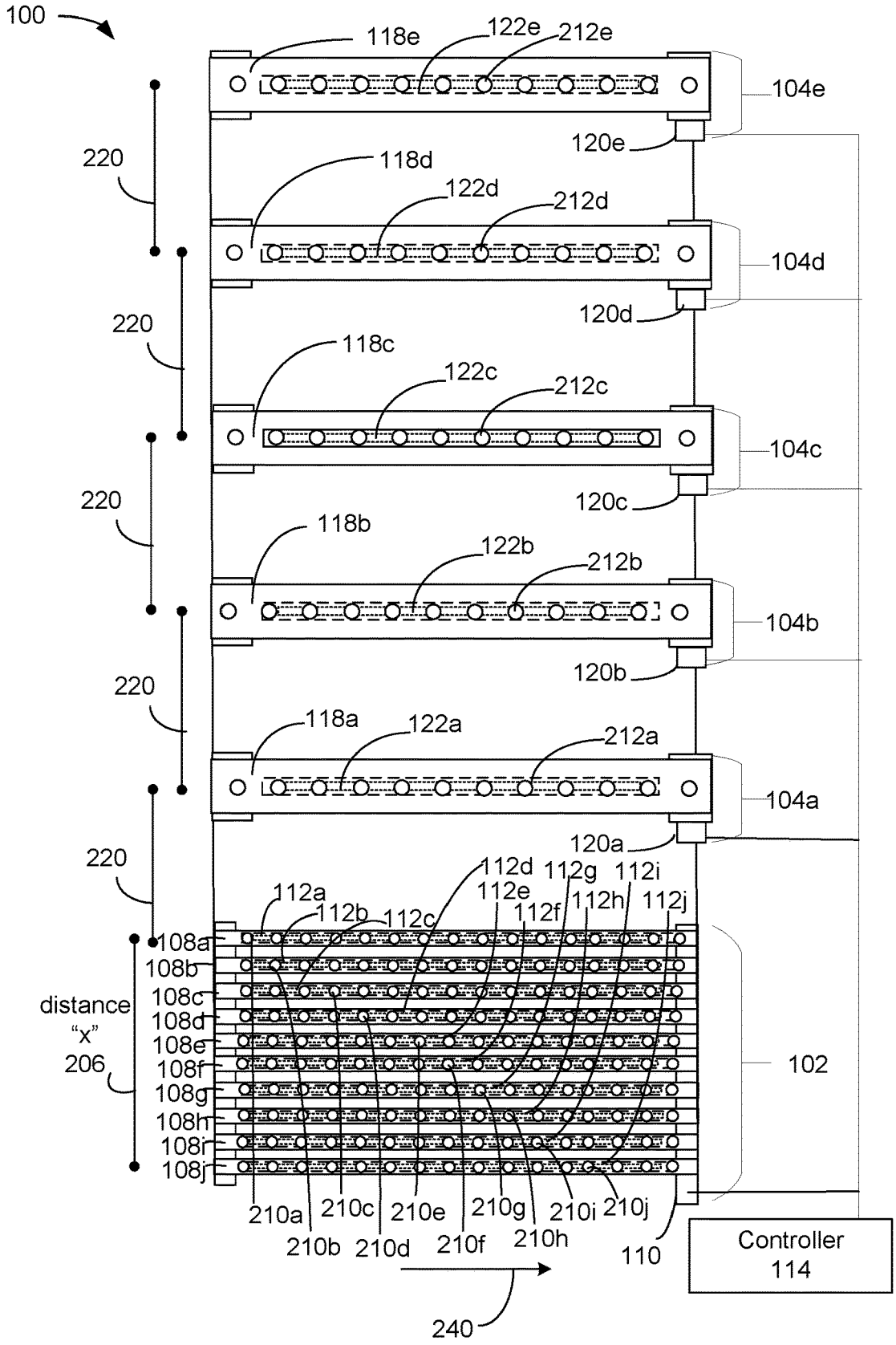
FIG. 8 is a simple schematic diagram that illustrates in plan view another example of a media sheet conveyance system.

FIG. 8 is a simple schematic diagram that illustrates in plan view another example of a media sheet conveyance system. The media conveyance system 100 of FIG. 8 is substantially similar to the system as described with respect to FIGS. 2A and 2B, except that the plurality of rows of holes of the first transport assembly 102 are distributed across a set of belts, rather than included in a single belt 108 as described with respect to FIGS. 2A and 2B. In the example of FIG. 8, the first transport assembly 110 includes a set of endless belts 108*a*-108*j* positioned in parallel, the set having a plurality of rows of holes 210*a*-210*j* including a first edge row 210*a* and a second edge row 210*j*. The first edge row 210*a* of holes and the second edge row 210*j* of holes are separated by a distance "x" 206. The first transport assembly includes a drive roller 110 operatively connected to drive surfaces of the set of belts 108*a*-108*i*, the drive roller 110 to circulate the set of belts 108*a*-108*j* above a vacuum element set 112*a*-112*j* situated adjacent and beneath drive surfaces of the set of belts 108*a*-108*i*.

The media conveyance system includes a plurality of subject transport assemblies 104*a*-104*e*. Each of the subject transport assemblies 104*a*-104*e* includes an endless subject belt 118*a*-118*e* having a subject edge row 212*a*-212*e* of holes, with a distance 220 between the subject edge row and a nearest edge row of an adjacent transport assembly that is less than or equal to the distance "x" 206.

In the example of FIG. 8, each of the subject transport assemblies 104*a*-104*e* includes a subject drive roller 120*a*-120*e* operatively connected to a drive surface of the subject belt 118*a*-118*e* to circulate the subject belt above a subject vacuum element 122*a*-122*e*. The subject vacuum element of each of the subject transport assemblies 104*a*-104*e* is to apply a negative pressure through holes of that subject transport assembly's subject belt.

The controller 114, in order to convey a media sheet (see e.g., media sheet 1504 FIGS. 15A-15D) in a media movement direction 240, is to control the drive roller 110 to circulate the set of belts 108*a*-108*j* over the vacuum element set 112*a*-112*j*. The controller 114, in order to convey a media sheet (see e.g., 1504 FIGS. 15A-D) in a media movement direction 240, is to contemporaneously control the subject drive rollers 120*a*-120*e* to circulate each of the subject belts 118*a*-118*e* over its respective subject vacuum element of vacuum element set 112*a*-112*i*. In examples the controller 114 is to control the vacuum element set 112*a*-112*f* and the subject vacuum elements 122*a*-122*f* to apply a target negative pressure to the media sheet through the rows of holes in the set of belts 108*a*-108*j* and the subject belts 118*a*-118*e*.

In examples, the media conveyance system 100 of FIG. 8 may include a first encoder unit to measure movement of the set of belts, and, for each of the subject transport assemblies, a subject encoder unit to measure movement of the subject belt of that subject transport assembly. In these examples the controller 114 is to control the drive roller 110 and the subject drive rollers 120*a*-120*e* based upon belt movements measured by the first encoder unit and the subject encoder units.

Figure 9:
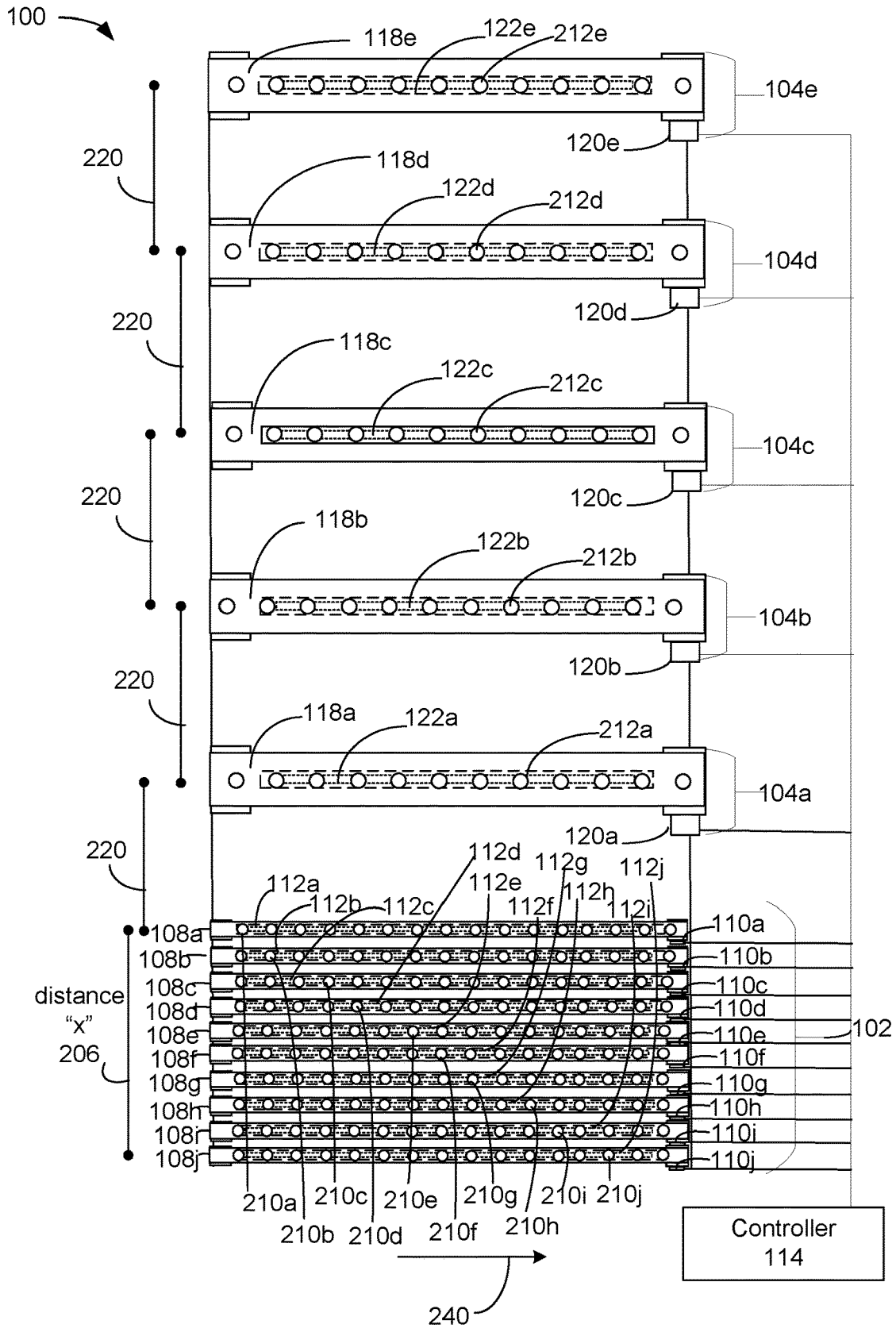
FIG. 9 is a simple schematic diagram that illustrates in plan view another example of a media sheet conveyance system.

FIG. 9 is a simple schematic diagram that illustrates in plan view another example of a media sheet conveyance system. The media conveyance system 100 of FIG. 9 is substantially similar to the system as described with respect to FIG. 8, except that the set of belts 108*a*-108*j*, rather than being drive by a single drive roller, are each driven by a dedicated drive roller 110*a*-110*j*. For instance, the drive roller 110*a* is operatively connected to the belt 108*a* of the set of belts, the drive roller 110*b* is operatively connected to the belts 108*b* of the set of belts, and so on. Each of the drive rollers 110*a*-110*j* is to circulate a belt of the set of belts 108*a*-108*j* of the first transport assembly 102 above a dedicated vacuum element of the vacuum elements 112*a*-112*j*.

The controller 114, in order to convey a media sheet in a media movement direction 240, is to control the set of drive rollers 110*a*-110*j* to circulate the set of belts 108*a*-108*j* over the set of vacuum elements 112*a*-112*j* of the first transport assembly 102. In order to convey the media sheet in the media direction 240, the controller 114 is to contemporaneously control the subject drive rollers 120*a*-120*e* to circulate each of the subject belts 118*a*-118*e* over its respective subject vacuum element of vacuum element 122*a*-122*e*. In examples the controller 114 is to control the set of vacuum elements 112*a*-112*f* and the subject vacuum elements 122*a*-122*f* to apply a target negative pressure to the media sheet through the rows of holes in the set of belts 108*a*-108*j* and the subject belts 118*a*-118*e*. In this manner the controller 114 controls movement of the belts and the vacuum elements to cause precise transport of the media sheet.

Figure 10:
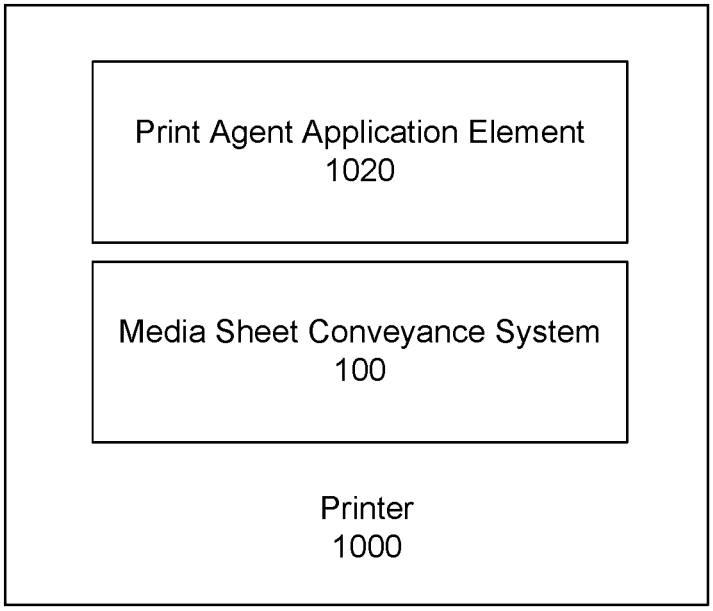
FIG. 10 is a block diagram depicting an example of a printer with a media sheet conveyance system.

FIG. 10 is a block diagram depicting an example of a printer with a media sheet conveyance system. In this example, a printer 1000 includes a print agent application element 1020 and a media conveyance system 100. In examples the print agent application component may include a printhead or set of printheads. In examples the media conveyance system 100 may be as disclosed with respect to the examples of FIGS. 1-9 discussed herein.

Figure 11:
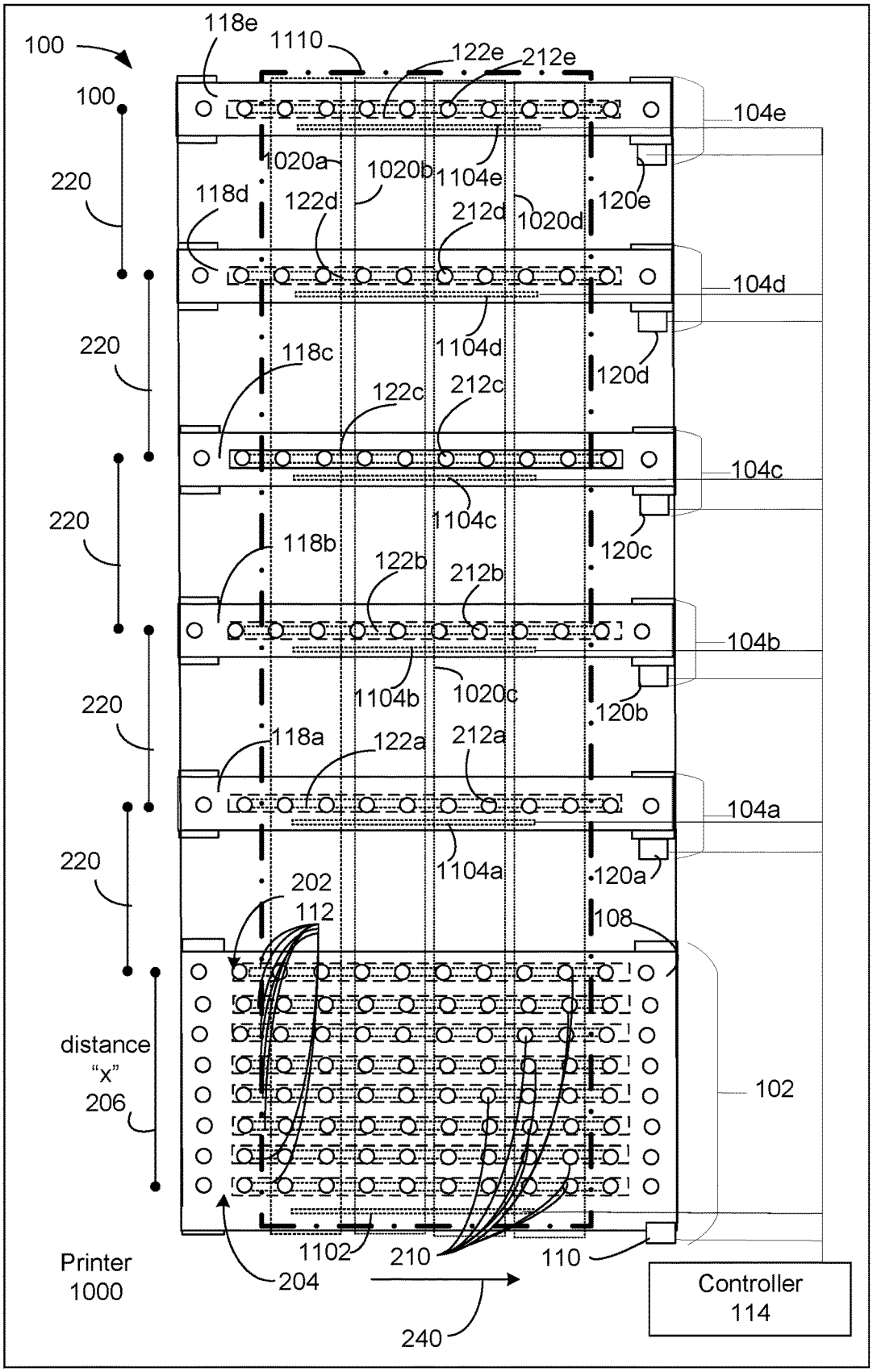
FIG. 11 is a simple schematic diagram that illustrates in plan view a particular example of a printer with a media sheet conveyance system.

FIG. 11 is a simple schematic diagram that illustrates in plan view a particular example of a printer that has a media sheet conveyance system with multiple transport assemblies. In this example, the printer 1000 includes a plurality of print agent application elements 1020*a* 1020*b* 1020*c* 1020*d* to apply a print agent to a media sheet within a print zone 1110. The printer 1000 includes a media sheet conveyance system 100, the system including a first transport assembly 102, a set of plurality of subject transport assemblies 104*a*-104*e*, and a controller 114.

As used herein a "print agent" refers generally to any substance (e.g. ink, dry toner, liquid toner, varnish, primer, etc.) that can be applied to a sheet media to form an image. As used herein a "print zone" refers generally to an area, situated beneath or otherwise adjacent to a print agent application element of a printer, within, in or under which the print agent application element is to apply a print agent to a media.

In examples the print agent application elements are printheads and are to eject a liquid print agent upon a media sheet as it is conveyed by the media conveyance system 100 through the print zone 1110. As used herein, a "printhead" refers generally to a mechanism for ejection of a liquid, e.g., a liquid print agent. Examples of printheads are drop on demand printheads, such as piezoelectric printheads and thermo resistive printheads. As used herein, "liquid print agent" refers generally to any liquid that can be applied upon a media by a printer during a printing operation, e.g., a liquid print agent ejection operation, including but not limited to inks, primers and overcoat materials (such as a varnish), water, and solvents other than water. As used herein an "ink" refers generally to a liquid that is to be applied to a media during a printing operation, e.g., a liquid print agent ejection operation to form an image upon the media or to service a printhead. As used herein, a primer refers generally to a liquid substance that is applied to a media as a preparatory coating in advance of an application of ink or another image-forming print fluid to a media.

In this particular example the print agent application elements 1020*a* 1020*b* 1020*c* 1020*d* are printheads, each for applying a different color of liquid print agent to a media, and the print zone 1110 is an area situated adjacent and beneath the printhead print agent application elements.

In this example the first transport assembly 102 includes an endless first belt set 108 with a plurality of rows 210 of holes, the plurality including a first edge row 202 and a second edge row 204 separated by a distance "x" 206. In this particular example the belt set 108 has a single belt. In other examples, the belt set 108 may include a plurality of belts (see, e.g., FIGS. 8 and 9). A first drive roller 110 is operatively connected to a drive surface (see e.g., 308, FIGS. 12A-12D) of the first belt set 108. A first vacuum element set 112 is positioned adjacent and beneath the drive surface (see e.g., 308, FIGS. 3A and 3B) of the first belt set 108.

Continuing at FIG. 11, the media conveyance system 100 of the printer 1000 includes a set of subject transport assemblies 104*a*-104*e*. Each of the set of subject transport assemblies 104*a*-104*e* includes an endless subject belt 118*a*-118*e* having a subject edge row 212*a*-212*e* of holes, with a distance 220 to a nearest edge row of an adjacent transport assembly being less than or equal to the distance "x" 206. In an example, the distances 220 between an edge row of the first transport assembly 102 and a subject edge row of the subject transport assembly 1 104*a*, and as between subject edge rows of each of the subject transport assemblies 1-5 104*a*-104*e*, are each less than or equal to the distance "x" 206.

Each of the set of subject transport assemblies 104*a*-104*e* includes a subject drive roller 120*a*-120*e* operatively connected to a drive surface (see e.g., 408, FIGS. 13A-13D) of the subject belt 118*a*-118*e* of that subject transport assembly. Each of the set of subject transport assemblies 104*a*-104*e* includes a subject vacuum element 122*a*-122*e* positioned adjacent and beneath a drive surface (see e.g., 408, FIGS. 4A and 4B) of the subject belt 118*a*-118*e* of that subject transport assembly.

The media conveyance system 100 of the printer 1000 includes a controller 114 to control the first drive roller 110 and the subject drive rollers 120*a*-120*e* to move a media sheet through the print zone 1110. The controller 114 is to control the first drive roller 110 to circulate the first belt set 108 over the first vacuum element set 112, and is to control the subject drive rollers 120*a*-120*e* to independently circulate each of the subject belts 118*a*-118*e* over a subject vacuum element 122*a*-122*e* positioned adjacent to that subject belt.

Continuing with the example of FIG. 11, the first transport assembly 102 includes a first encoder unit 1102 situated within the print zone 1110 of the printer 1000. The first encoder unit 1102 is to measure movement of the first belt set 108. In this example each of the plurality of subject transport assemblies 104*a*-104*e* includes a subject encoder unit 1104*a*-1104*e*, each situated within the print zone 1110 of the printer 1000, to measure movement of a subject belt 118*a*-118*e*.

In the particular example of FIG. 11, the first encoder unit 1102 is positioned within the print zone 1110 and is to measure movement of the first belt 108. A subject encoder 1104*a* is positioned within the print zone 1110 and is to measure movement of the subject belt 118*a*. A subject encoder 1104*b* is positioned within the print zone 1110 and is to measure movement of the subject belt 118*a*. A subject encoder 1104*c* is positioned within the print zone 1110 and is to measure movement of the subject belt 118*c*. A subject encoder 1104*d* is positioned within the print zone 1110 and is to measure movement of the subject belt 118*d*. A subject encoder 1104*e* is positioned within the print zone 1110 and is to measure movement of the subject belt 118*e*.

Figure 12A:
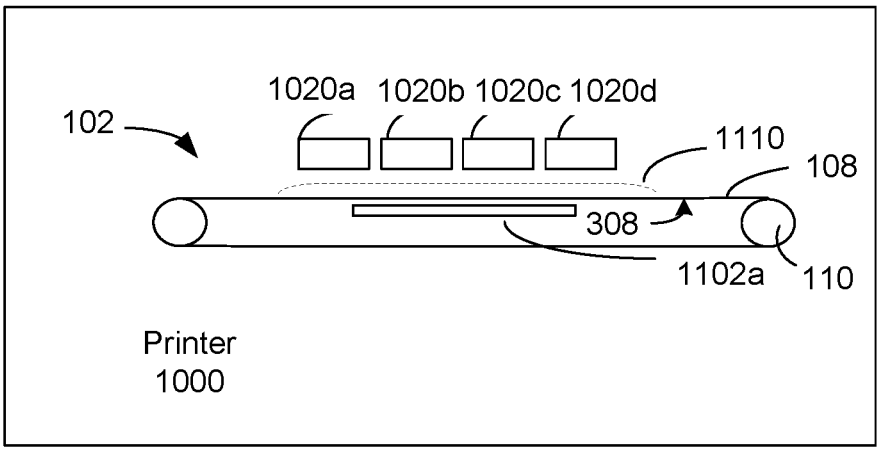
FIGS. 12A-12D are simple schematic diagrams that illustrate in section views examples of a first encoder unit within a first transport assembly.
Figure 12B:
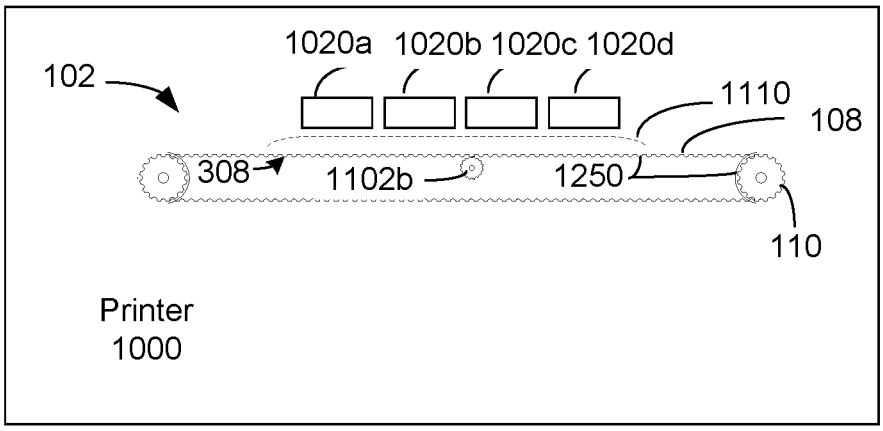
Figure 12C:
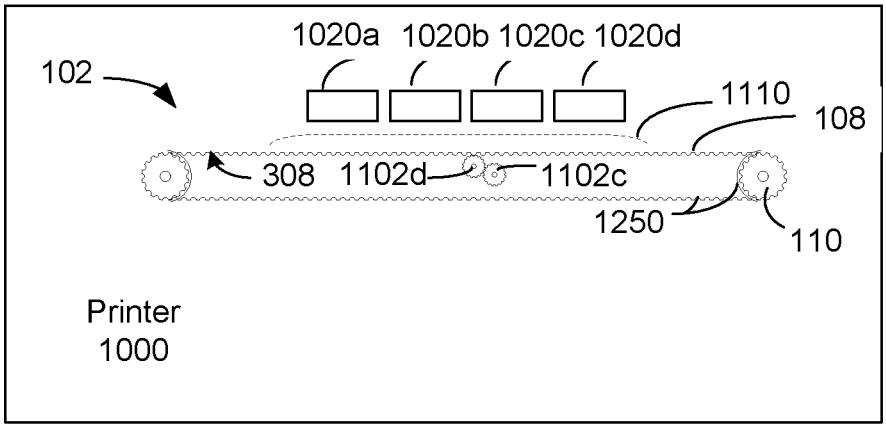
Figure 12D:
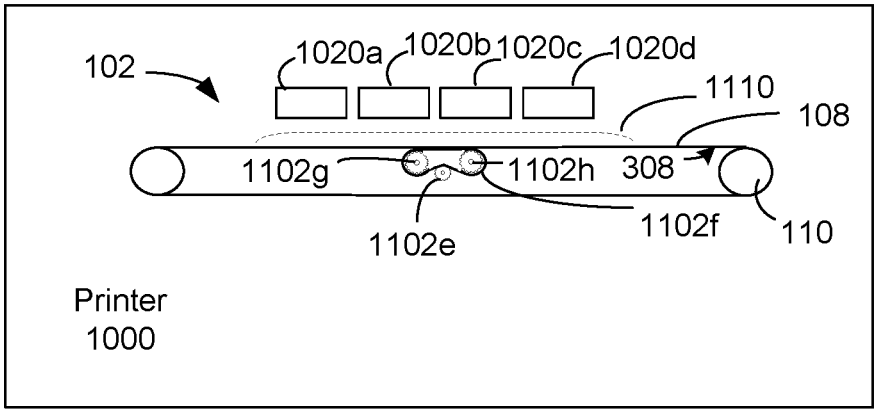

FIGS. 12A-12D are simple schematic diagrams that illustrate, in view of FIG. 11, section diagrams of examples of a first encoder unit within a first transport assembly. FIG. 12A illustrates an example wherein the first encoder unit 1102 (FIG. 11) is or includes an optical sensor 1102*a* positioned within a print zone 1110 to detect and measure movement of the first belt 108 of the first transport assembly 102. FIG. 12B illustrates an example wherein a first encoder unit 1102 (FIG. 11) positioned within a print zone 1110 is or includes a wheel encoder 1102*b* that is operatively connected to a drive surface 308 of the first belt 108. In this manner the first encoder unit 1102 (FIG. 11) is to provide a direct measurement of the movement of the first belt 108. FIG. 12C illustrates an example wherein the first encoder unit 1102 (FIG. 11) positioned within a print zone 1110 is or includes a wheel encoder 1102*c* operatively connected to an intermediary roller 1102*d*, wherein the intermediary roller 1102*d* is in direct contact with a drive surface 308 of the first belt 108. In this manner the first encoder unit 1102 (FIG. 11) is to provide an indirect measurement of the movement of the first belt 108. FIG. 12D illustrates an example wherein the first encoder unit 1102 (FIG. 11) positioned within a print zone 1110 is or includes a wheel encoder 1102*e* operatively connected to an intermediary belt 1102*f* that is in direct contact with a drive surface 308 of the first belt 108. The intermediary belt 1102*f* is operatively connected to a first support roller 1102*g* and a second belt support roller 1102*h*. In this manner the first encoder unit 1102 (FIG. 11) is to provide an indirect measurement of the movement of the first belt 108.

The section views of the examples of FIGS. 12B and 12C depict the drive roller 110 and a drive surface 308 of the belt 108 that is to engage the drive roller 110 as having teeth 1250, The section views of the examples of FIGS. 12A and 12D depict the drive roller 110 and a drive surface 308 of the belt 108 that is to engage the drive roller 110 without either the belt 108 or the drive roller 110 having teeth. It should be noted that any of the examples of first transport assemblies described herein may have a drive roller 110 with or without teeth, and a belt 108 with or without teeth to engage the drive roller 110.

The vacuum element set 112 that is situated adjacent and beneath the drive surface 308 of the first belt 108 of FIG. 11, is not depicted in FIGS. 12A-12D. FIGS. 3A-3C, discussed previously, provide section view examples of a vacuum element set 112.

Figure 13A:
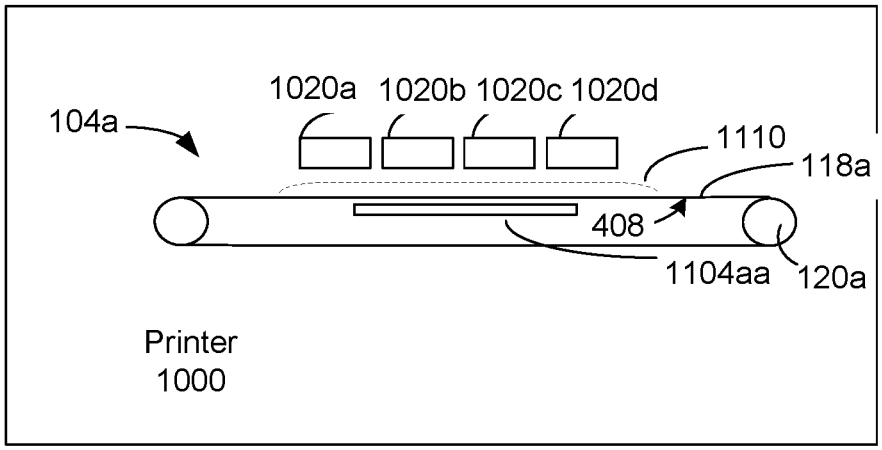
FIGS. 13A-13D are simple schematic diagrams that illustrate in section views examples of a subject encoder unit within a subject transport assembly.
Figure 13B:
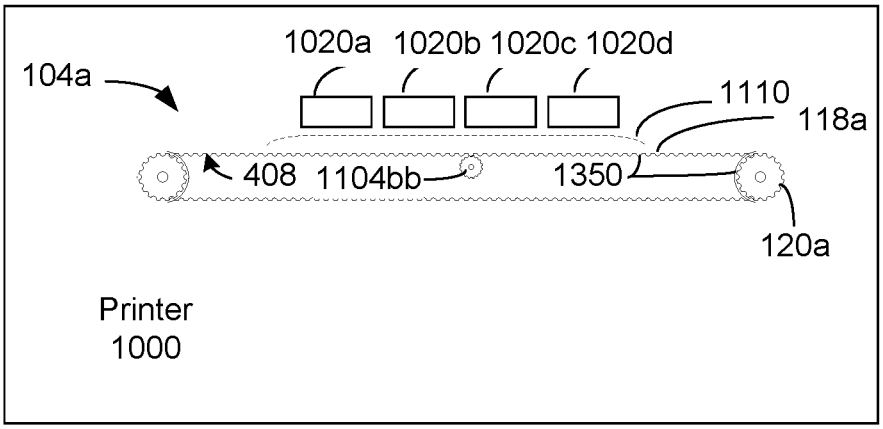
Figure 13C:
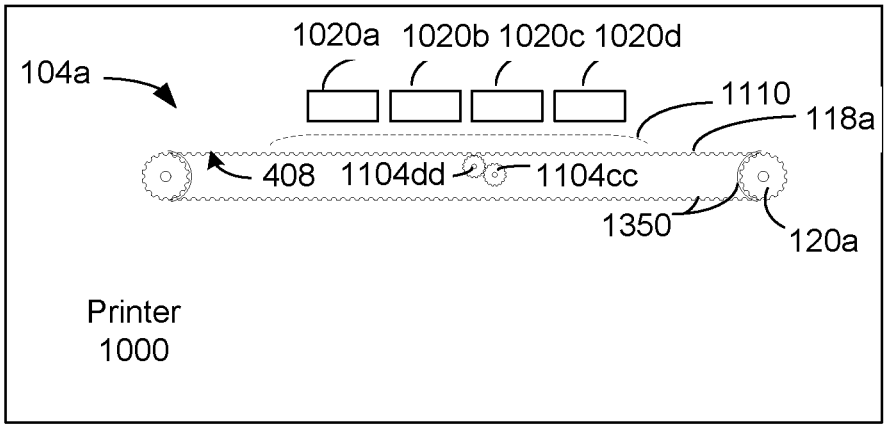
Figure 13D:
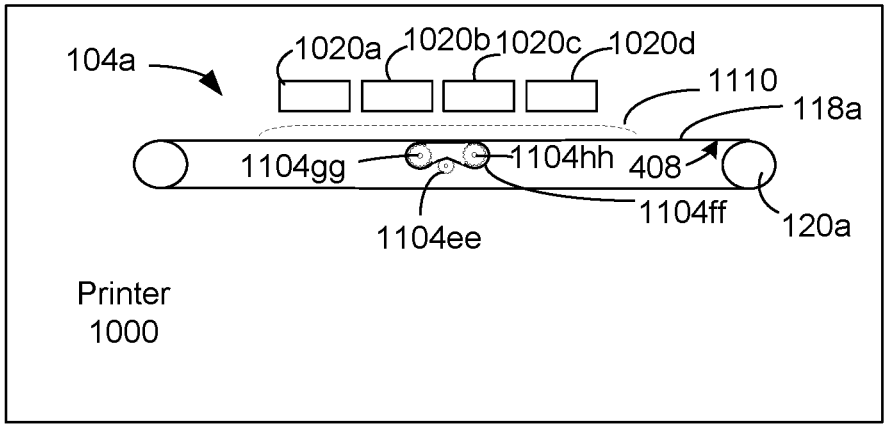

FIGS. 13A-13D are simple schematic diagrams that illustrate, in view of FIG. 11, section diagrams of examples of a subject encoder unit within a subject transport assembly. FIG. 13A illustrates an example wherein the subject encoder unit 1104*a* (FIG. 11) positioned within a print zone 1110 is or includes an optical sensor 1104*aa* to detect and measure movement of the subject belt 118*a* of the subject transport assembly 104*a*. FIG. 13B illustrates an example wherein a subject encoder unit 1104*a* (FIG. 11) positioned within a print zone 1110 is or includes a wheel encoder 1104*bb* that is operatively connected to a drive surface 408 of the subject belt 118*a*. In this manner the subject encoder unit 1104*a* (FIG. 11) is to provide a direct measurement of the movement of the subject belt 118*a*. FIG. 13C illustrates an example wherein the subject encoder unit 1104*a* (FIG. 11) positioned within a print zone 1110 is or includes a wheel encoder 1104*cc* operatively connected to an intermediary roller 1104*dd*, wherein the intermediary roller 1104*dd* is in direct contact with a drive surface 408 of the subject belt 118*a*. In this manner the subject encoder unit 1104*a* (FIG. 11) is to provide an indirect measurement of the movement of the subject belt 118*a*. FIG. 13D illustrates an example wherein the subject encoder unit 1104*a* (FIG. 11) positioned within a print zone 1110 is or includes a wheel encoder 1104*ee* operatively connected to an intermediary belt 1104*ff* that is in direct contact with a drive surface 408 of the subject belt 118*a*. The intermediary belt 1104*ff* is operatively connected to a first support roller 1104*gg* and a second belt support roller 1104*hh*. In this manner the subject encoder unit 1104*a* (FIG. 11) is to provide an indirect measurement of the movement of the subject belt 118*a*.

The section views of the examples of FIGS. 13B and 13C depict the subject drive roller 120*a* and a drive surface 408 of the subject belt 118*a* that is to engage the drive roller 120 as having teeth 1350, The section views of the examples of FIGS. 13A and 13D depict the subject drive roller 120*a* and a drive surface 408 of the subject belt 118*a* that is to engage the subject drive roller 120*a* without either the subject belt 118*a* or the subject drive roller 120*a* having teeth. It should be noted that any of the examples of subject transport assemblies described herein may have a subject drive roller 120*a* with or without teeth, and a subject belt 118*a* with or without teeth to engage the subject drive roller 120*a*.

The vacuum element 122*a* that is situated adjacent and beneath the drive surface 408 of the belt 118*a* of the transport assembly 1 104*a* of FIG. 11 is not depicted in FIGS. 13A-13D. FIGS. 4A and 4B, discussed previously, provide section view examples of a vacuum element 122*a*.

Returning to FIG. 11, the controller 114 is operatively connected to the first encoder unit 1102 and to each of the subject encoder units 1104*a*-1104*e*, and is to control the first drive roller 110 and at least one of the subject drive rollers 120*a*-120*e* based upon belt movement measurements made by the first encoder unit 1102 and the subject encoder units 1104*a*-1104*e*.

In a particular example, the controller 114 is to control the first drive roller 110 and one or more of the subject drive rollers 120*a*-120*e* by varying a speed of first drive roller 110 or varying a speed of the subject drive roller(s) based on a movement of the first belt and a movement of the subject belt(s) as measured by the first encoder unit 1102 and the subject encoder unit(s) 1104*a*-1104*e*. For example, the controller 114 may control the first drive roller 110 and at least one of the subject drive rollers of the set (e.g., subject drive roller 120*a* of the first subject transport assembly 104*a*) by varying a speed of first drive roller 110 and varying speed of the subject drive roller 120*a*) based on a movement of the first belt 108 as measured by the first encoder unit 1102 and a movement of the first subject belt 118*a* as measured by the first subject encoder unit 1104*a*. In examples, the controller 114 may cause the speeds of one or more of the other subject drive rollers of the set of subject drive rollers 104*a*-104*e* to be independently increased or decreased based upon movements of the subject belts 118*b*-118*e* as measured by the subject encoder units 1104*b*-1104*e*.

In certain examples where the print application elements 1020*a* 1020*b* 1020*c* 1020*d* are printheads, the controller 114 is to synchronize printhead firing signals for the printheads 1020*a* 1020*b* 1020*c* 1020*d* based on a movement of the first belt 108 and movement of the subject belts 118*a*-118*e* as measured by the first encoder unit 1102 and the subject encoder units 1104*a*-1104*e*. As used herein, a "printhead firing signal" refers generally to a variance in voltage, current, electromagnetic wave, or another medium that when provided to a printhead is to establish, or cause a change in, that printhead's timing and/or the volume of a liquid print agent ejected by the printhead during a printing operation or a non-printing operation.

In the foregoing discussion of FIGS. 1-13D, controller 114 was described as a combination of hardware and programming. Controller 114 may be implemented in a number of fashions. Looking at FIG. 14 the programming may be processor executable instructions stored on a tangible memory resource 1450 and the hardware may include a processing resource 1460 for executing those instructions. Thus, memory resource 1450 can be said to store program instructions that when executed by processing resource 1460 implement the controller 114 of FIGS. 1-13D.

Memory resource 1450 represents generally any number of memory components capable of storing instructions that can be executed by processing resource 1460. Memory resource 1450 is non-transitory in the sense that it does not encompass a transitory signal but instead is made up of a memory component or memory components to store the relevant instructions. Memory resource 1450 may be implemented in a single device or distributed across devices. Likewise, processing resource 1460 represents any number of processors capable of executing instructions stored by memory resource 1450. Processing resource 1460 may be integrated in a single device or distributed across devices. Further, memory resource 1450 may be fully or partially integrated in the same device as processing resource 1460, or it may be separate but accessible to that device and processing resource 1460.

In one example, the program instructions can be part of an installation package that when installed can be executed by processing resource 1460 to implement device 100. In this case, memory resource 1450 may be a portable medium such as a CD, DVD, or flash drive or a memory maintained by a server from which the installation package can be downloaded and installed. In another example, the program instructions may be part of an application or applications already installed. Here, memory resource 1450 can include integrated memory such as a hard drive, solid state drive, or the like.

Figure 14:
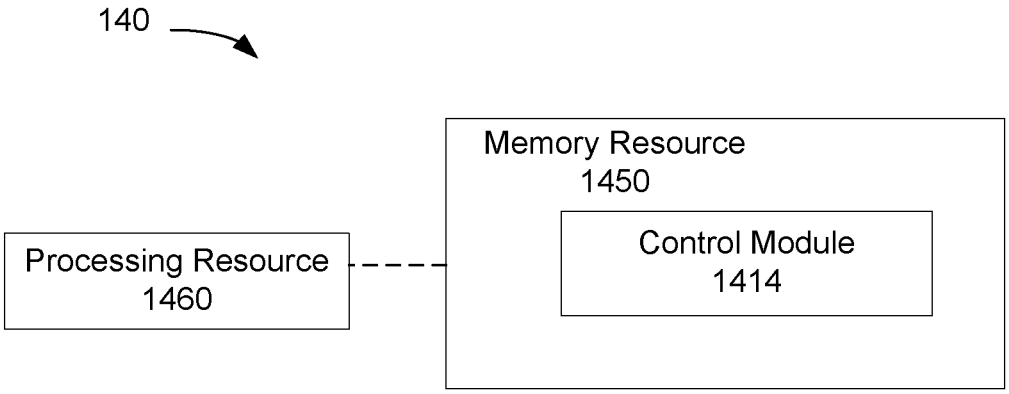
FIG. 14 is a block diagram depicting a memory resource and a processing resource to implement an example of media sheet conveyance.
Figure 15B:
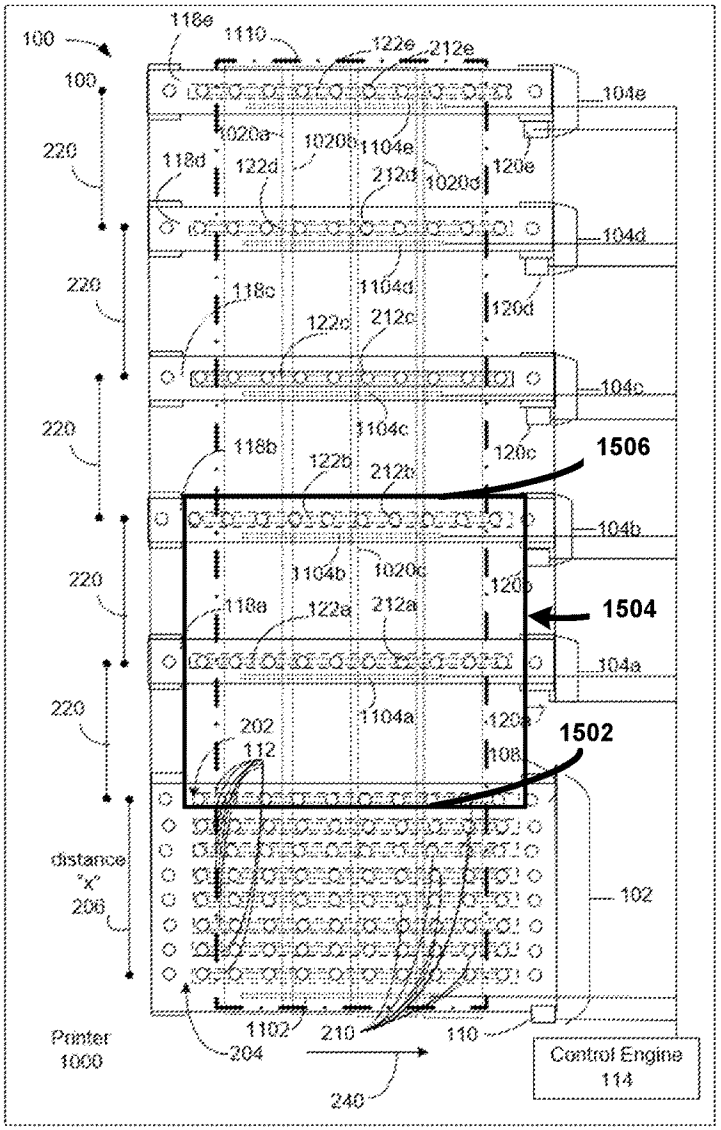
FIGS. 15A-15D are simple schematic diagrams depicting an example of media sheet conveyance utilizing multiple transport assemblies.
Figure 15A:
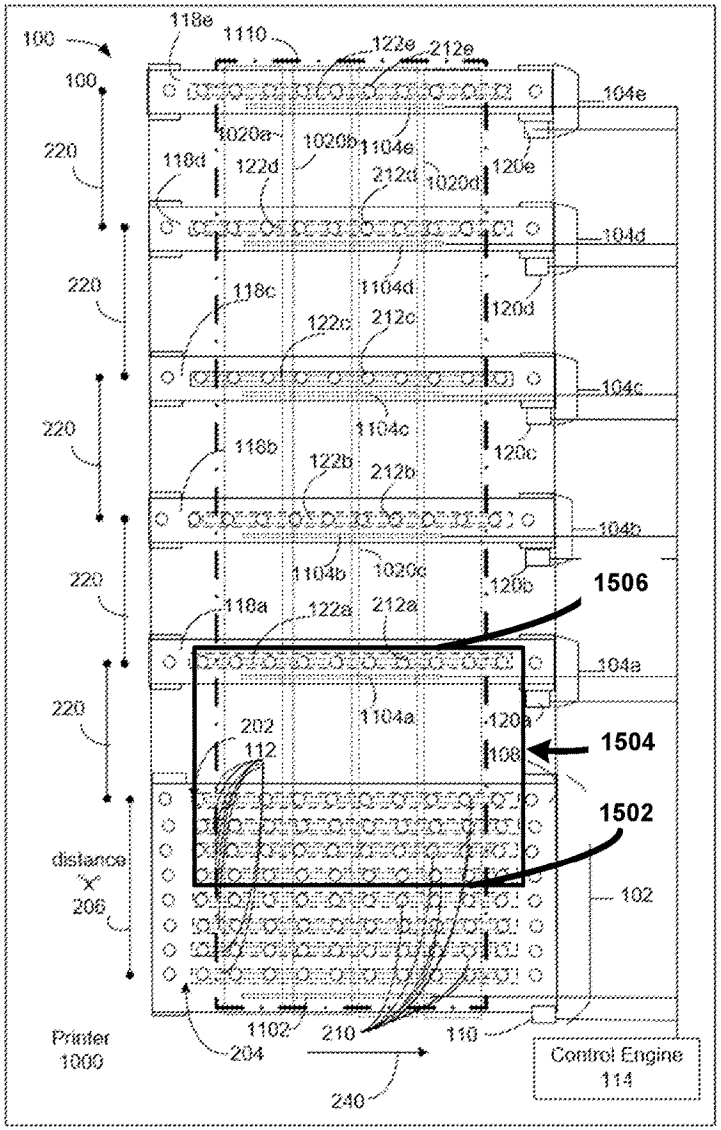
Figure 15D:
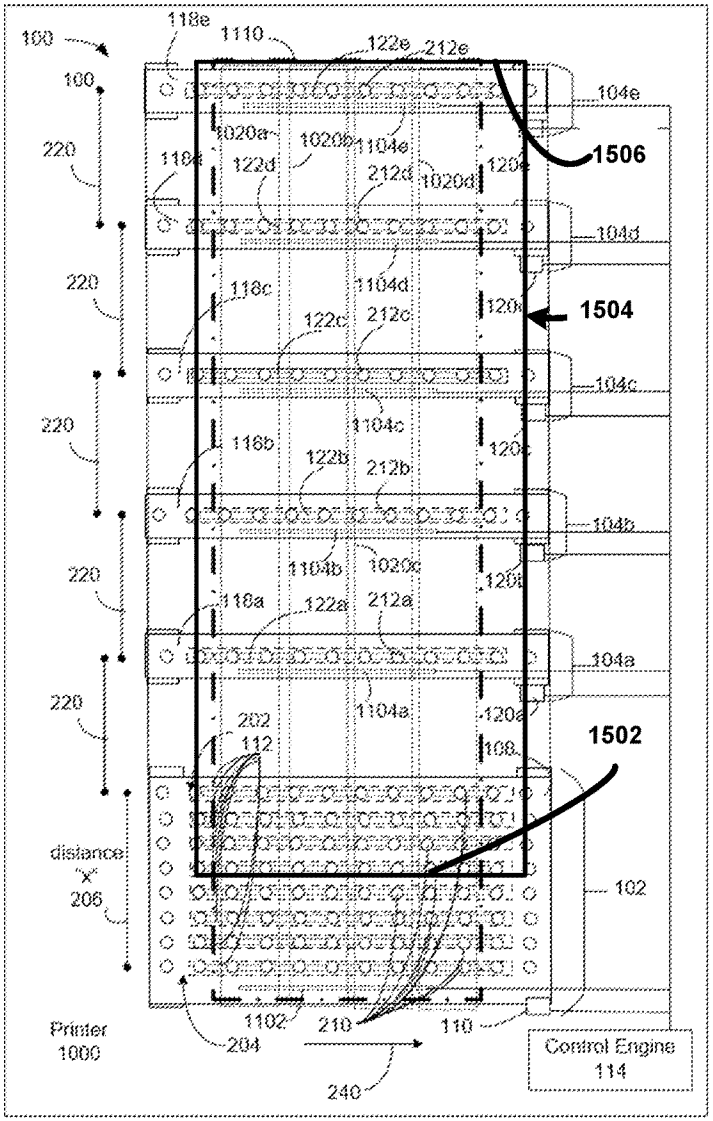
Figure 15C:
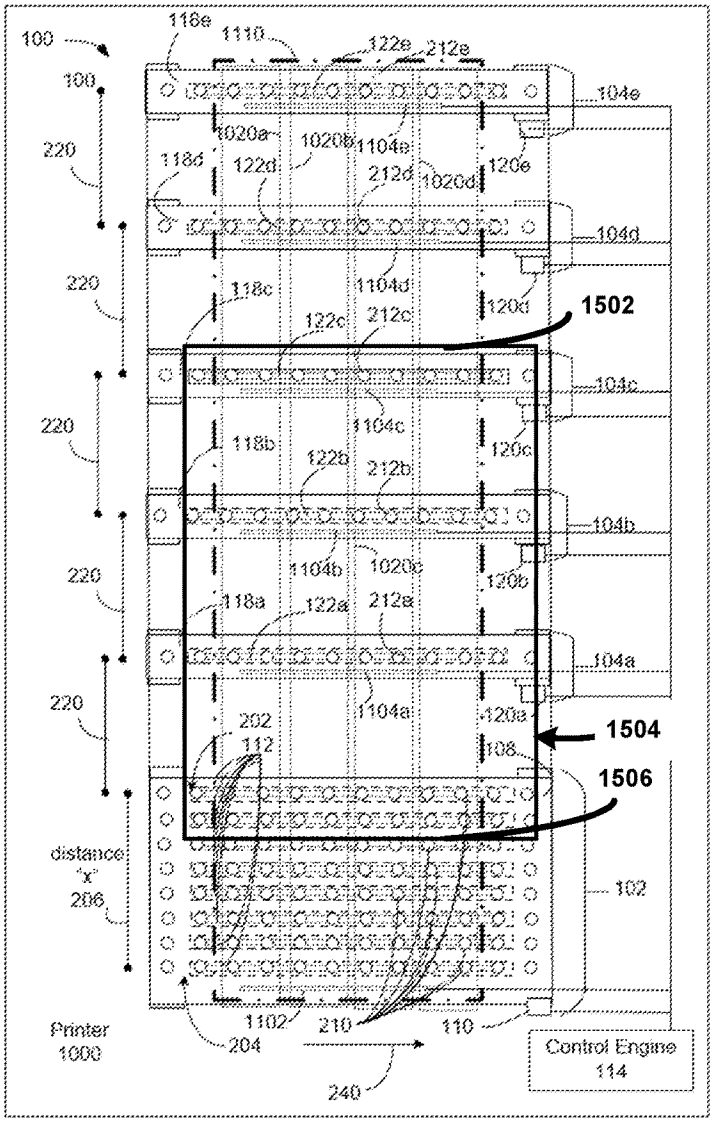

Continuing at FIG. 14, the executable program instructions stored in memory resource 1450 are depicted as a control module 1414. Control module 1414 represents program instructions that when executed by processing resource 1460 may perform any of the functionalities described above in relation to controller 114 of FIGS. 1-13D.

FIGS. 15A-15D are simple schematic diagrams depicting examples of media sheet conveyance utilizing multiple transport assemblies. The examples of FIGS. 15A-15D demonstrate how the disclosed media conveyance system 100 can be used to transport media sheets of differing widths through a print zone 1110 of a printer. The example printer 1000 of FIGS. 15A-15D includes a media conveyance system 100 and is substantially similar to the printer 1000 and media conveyance system 100 discussed with respect to FIG. 11.

In each of the examples of FIGS. 15A-15D, a first lateral edge 1502 of a rectangular media sheet 1504 is positioned upon the first belt 108 of the first transport assembly 102 such that the first lateral edge 1502 covers, or partially covers, holes of a row of the rows of holes 210 of the first transport assembly 102.

A second lateral edge 1506 of the media sheet 1504 is positioned upon a subject belt (118*a* in FIG. 15A, 118*b* in FIG. 15B, 118*c* in FIG. 15C, and 118*e* in FIG. 15D) of a subject transport assembly (104*a* in FIG. 15A, 104*b* in FIG. 15B, 104*c* in FIG. 15C, and 104*e* in FIG. 15D) such that the second lateral edge 1506 covers, or partially covers, holes of the row of holes of that subject belt. As used herein, a "lateral edge" of a media sheet refers generally to an edge of a media sheet that is not a leading edge or a trailer edge of the media sheet as it is being conveyed in a media conveyance direction.

In this manner, the first lateral edge 1502 of the media sheet 1504 is exposed, through the holes of the first belt 108 of the first transport assembly 102 to a negative pressure applied by a vacuum element 112 of the of the first transport assembly 102. The second lateral edge 1506 of the media sheet 1504 is contemporaneously exposed through the holes of the row of holes of applicable subject belt (118 in FIG. 15A, 118*b* in FIG. 15B, 118*c* in FIG. 15C, and 118*e* in FIG. 15D) to a negative pressure applied by a vacuum element positioned adjacent and beneath the row of holes. In this manner each of the first lateral edge 1502 is held tightly to the first belt 108 belt of the first transport apparatus 102, and the second lateral edge 1506 is held tightly to a belt of a subject transport assembly (104*a* in FIG. 15A, 104*b* in FIG. 15B, 104*c* in FIG. 15C, and 104*e* in FIG. 15D), thereby enabling accurate media conveyance through the print zone 1110 and enhanced print quality.

FIGS. 1-15D aid in depicting the architecture, functionality, and operation of various examples. FIGS. 1-15D depict various physical and logical components, and various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor-based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A media sheet conveyance system, comprising:

a first transport assembly, including an endless first belt having a plurality of rows of holes, the plurality including a first and a second edge row separated by a distance "x";

a first drive roller operatively connected to the first belt;

a first vacuum element set positioned adjacent to a surface of the first belt;

a plurality of subject transport assemblies, each including an endless subject belt having fewer rows of holes than the endless first belt and including a subject edge row of holes, with a distance to a nearest edge row of an adjacent belt being less than or equal to the distance "x", a subject drive roller operatively connected to the subject belt;

a subject vacuum element positioned adjacent to a surface of the subject belt; and a controller to control the first drive roller and the subject drive rollers to move a media sheet, including controlling the first drive roller, to circulate the first belt over the first vacuum element set and controlling a subject drive roller to circulate a subject belt over a subject vacuum element.

2. The system of claim 1, wherein the plurality of rows of holes of the first belt extend along length of the belt; and wherein the first edge row of holes and the second edge row of holes are separated, in a direction orthogonal to the length of the first belt, by the distance "x".

3. The system of claim 1 wherein a subject transport assembly of the plurality of subject transport assemblies includes an endless subject belt with a subject edge row of holes, with a distance to a nearest edge row of holes of a first adjacent transport assembly being less than or equal to the distance "x", and a distance to a nearest edge row of a second adjacent transport assembly being less than or equal to the distance "x".

4. The system of claim 1 wherein the controller is to control the first vacuum element set to apply a target negative pressure to the media sheet through the holes in the first belt, and to control a subject vacuum element to apply a target negative pressure to the media sheet through the holes in a subject belt.

5. The system of claim 1, wherein the first transport assembly includes a first encoder unit to measure movement of the first belt;

wherein each of the plurality of subject transport assemblies includes a subject encoder unit to measure movement of the subject belt; and wherein the controller is operatively connected to the first encoder unit and to each of the subject encoder units, and is to control the first drive roller and the subject drive rollers based upon belt movements measured by the first encoder unit and the subject encoder units.

6. The system of claim 5, wherein the system is included within a printer that is to apply a print agent to the media sheet in a print zone of the printer, and wherein the first encoder unit and the subject encoder units are positioned within the print zone.

7. The system of claim 5, wherein the controller controlling the first drive roller and the subject drive rollers based upon belt movements measured by the first encoder unit and the subject encoder units comprises the controller is to vary a speed of a first drive roller or vary a speed of a subject drive roller based on a movement of the first belt and a movement of the subject belt as measured by the first encoder unit and a subject encoder unit.

8. The system of claim 5, wherein the controller is to control the first drive roller and the subject drive rollers based upon belt movements measured by the first encoder unit and the subject encoder unit comprises the controller is to control the first drive roller and the subject drive rollers to move the media sheet through a print zone, and is to synchronize a printhead firing signal based on a movement of the first belt and a movement of the subject belt as measured by the first encoder unit and a subject encoder unit.

9. The system of claim 1, wherein for a particular subject transport assembly of the plurality of subject transport assemblies the subject edge row of holes of the endless subject belt is a first subject edge row, and the adjacent belt is a first adjacent belt;

wherein the endless subject belt of the particular transport assembly includes a second subject edge row of holes; and wherein a subject edge row distance between the second subject edge row and a nearest edge row of holes of a second adjacent belt is less than or equal to the distance "x".

10. The system of claim 1, wherein the endless subject belt has a single row of holes.

11. The system of claim 10, wherein the endless first belt has eight rows of holes.

12. The system of claim 1, wherein the endless subject belt has two rows of holes.

13. The system of claim 12, wherein the endless first belt has eight rows of holes.

14. A system for conveying a media sheet, comprising:

a first transport assembly, including a set of endless belts positioned in parallel, the set having a plurality of rows of holes including a first edge row and a second edge row, the rows being separated by a distance "x";

a set of drive rollers operatively connected to the set of belts, to circulate the set of belts above a set of vacuum elements;

the set of vacuum elements to apply a negative pressure through holes of the set of belts;

a plurality of subject transport assemblies, each including an endless subject belt having fewer rows of holes than the set of endless belts and including a subject edge row of holes, with a distance between the subject edge row and a nearest edge row of an adjacent belt that is less than or equal to the distance "x", a subject drive roller operatively connected to the subject belt to circulate the subject belt above a subject vacuum element;

the subject vacuum element to apply a negative pressure through holes of the subject belt; and a controller to control the set of drive rollers to circulate the set of belts above the set of vacuum elements, and to control a subject drive roller to circulate a subject belt above a subject vacuum element, to convey a media sheet.

15. The system of claim 14, wherein the controller is to control the set of vacuum elements and the subject vacuum elements to apply a target negative pressure to the media sheet through holes in the set of belts and in a subject belt.

16. The system of claim 14, comprising a first encoder unit to measure movement of the set of belts;

comprising, for each of the subject transport assemblies, a subject encoder unit to measure movement of the subject belt;

wherein the controller is to control the drive roller set and the subject drive rollers based upon belt movements measured by the first encoder unit and the subject encoder units.

17. The system of claim 14, wherein the set of drive rollers has exactly one drive roller that is operatively connected to each belt of the set of belts, and the one drive roller is to circulate the set of belts.

18. The system of claim 14, wherein the endless subject belt has a single row of holes.

19. The system of claim 14, wherein the endless subject belt has two rows of holes.

20. A printer comprising:

a plurality of print agent application elements to apply a print agent to a media sheet within a print zone;

media sheet conveyance system, including a first transport assembly, including an endless first belt set having a plurality of rows of holes, the plurality including a first and a second edge row separated by a distance "x";

a first drive roller operatively connected to a drive surface of the first belt set;

a first vacuum element set positioned adjacent and beneath the drive surface of the first belt set;

a first encoder unit positioned within the print zone to measure movement of the first belt a plurality of subject transport assemblies, each including an endless subject belt having a subject edge row of holes, with a distance to a nearest edge row of an adjacent transport assembly being less than or equal to the distance "x", a subject drive roller operatively connected to a drive surface of the subject belt;

a subject vacuum element positioned adjacent and beneath the drive surface of the subject belt;

a subject encoder unit within the print zone to measure movement of the subject belt;

and a controller to control the first drive roller and the subject drive rollers to move a media sheet through the print zone, including controlling the first drive roller to circulate the first belt set over the first vacuum element set and controlling a subject drive roller to circulate a subject belt over a subject vacuum element, wherein the controller is operatively connected to the first encoder unit and to each of the subject encoder units, and is to control the first drive roller and the subject drive rollers based upon belt movements measured by the first encoder unit and the subject encoder units.

* * * * *